US008827397B2

(12) United States Patent
Knauer

(10) Patent No.: US 8,827,397 B2
(45) Date of Patent: Sep. 9, 2014

(54) VARIABLE FORMAT WEB PRESS

(75) Inventor: Peter Knauer, Muenster/Lech (DE)

(73) Assignee: manroland web systems GmbH, Offenbach am Main (DE)

( * ) Notice: Subject to any disclaimer, the term of this patent is extended or adjusted under 35 U.S.C. 154(b) by 1278 days.

(21) Appl. No.: 12/555,016

(22) Filed: Sep. 8, 2009

(65) Prior Publication Data

US 2011/0050767 A1 Mar. 3, 2011

(30) Foreign Application Priority Data

Aug. 28, 2009 (DE) ..... 10 2009 039 278

(51) Int. Cl.

| | |
|---|---|
| ***B41J 29/38*** | (2006.01) |
| ***B41J 13/24*** | (2006.01) |
| ***B41L 47/46*** | (2006.01) |
| ***B41J 25/316*** | (2006.01) |
| ***B41J 3/60*** | (2006.01) |
| ***B41F 17/02*** | (2006.01) |
| ***B41F 11/00*** | (2006.01) |
| ***B65H 35/04*** | (2006.01) |
| ***B41J 11/66*** | (2006.01) |
| ***B65H 35/02*** | (2006.01) |
| ***B41F 23/04*** | (2006.01) |
| ***B41J 15/04*** | (2006.01) |
| *B41J 11/00* | (2006.01) |

(52) U.S. Cl.

CPC ..... *B41F 17/02* (2013.01); *B41J 25/316* (2013.01); *B41J 3/60* (2013.01); *B65H 2402/10* (2013.01); *B41J 11/002* (2013.01); *B41F 11/00* (2013.01); *B65H 35/04* (2013.01); *B41J 11/663* (2013.01); *B65H 35/02* (2013.01); *B41F 23/0403* (2013.01); *B65H 2301/4431* (2013.01); *B41J 15/04* (2013.01)

USPC ..... 347/9; 347/5; 347/16; 347/20; 347/40; 347/41; 347/42; 347/43; 347/101; 347/104; 347/105; 347/106; 347/107; 347/108; 400/621; 101/92; 101/93.07; 101/198

(58) Field of Classification Search

USPC ..... 347/5, 9, 16, 20, 40–43, 101, 104–108; 400/621; 270/8

See application file for complete search history.

(56) References Cited

U.S. PATENT DOCUMENTS

| | | | | | |
|---|---|---|---|---|---|
| 4,969,640 | A | * | 11/1990 | Littleton | 271/182 |
| 5,117,610 | A | | 6/1992 | Hartman et al. | |
| 5,176,371 | A | | 1/1993 | Rau et al. | |
| 5,518,570 | A | * | 5/1996 | Takagi et al. | 156/303 |
| 5,765,460 | A | * | 6/1998 | Wathieu | 83/37 |
| 5,906,156 | A | * | 5/1999 | Shibuya et al. | 101/93.12 |

(Continued)

FOREIGN PATENT DOCUMENTS

| | | | | | |
|---|---|---|---|---|---|
| DE | 40 30 863 | | | 4/1992 | |
| EP | 0 813 972 | A2 | | 12/1997 | |
| JP | 03071851 | A | * | 3/1991 | B41J 2/01 |
| WO | WO 2009/145777 | A1 | | 12/2009 | |

*Primary Examiner* — Ryan Lepisto
*Assistant Examiner* — Guy Anderson
(74) *Attorney, Agent, or Firm* — Cozen O'Connor

(57) ABSTRACT

A web press, in particular a variable format book web press, variable format newspaper web press, or variable format periodical web press, has printing units having printing devices or groups of printing devices for applying ink to a paper web. The printing devices or groups of printing devices are constructed without rotating impression cylinders and are designed to apply ink to the paper web in a noncontacting manner.

43 Claims, 27 Drawing Sheets

(56) References Cited

U.S. PATENT DOCUMENTS

Figure 1:
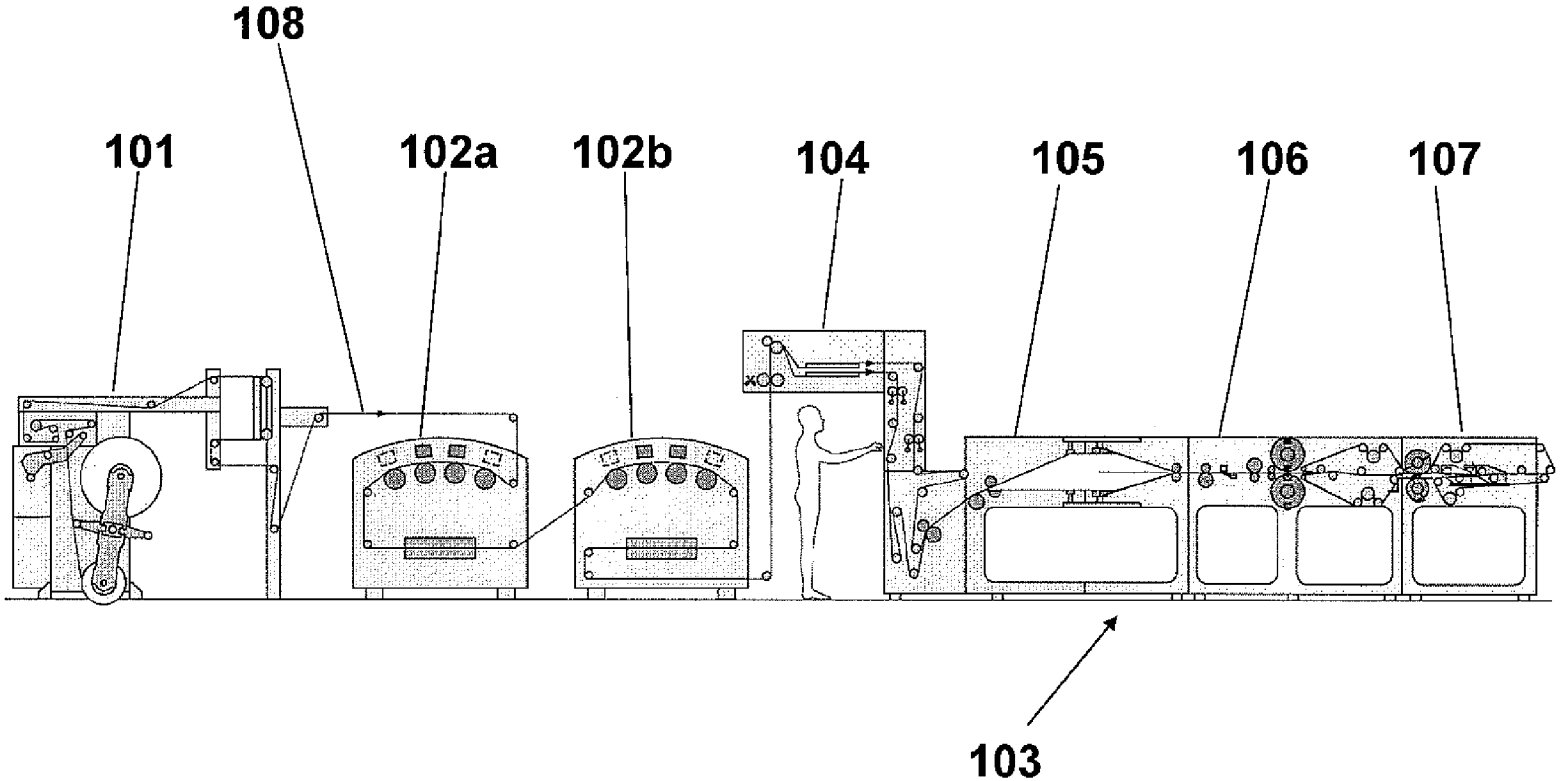

| | | | | |
|---|---|---|---|---|
| 6,865,864 | B2 * | 3/2005 | Katz | 53/460 |
| 8,235,484 | B2 * | 8/2012 | Ray et al. | 347/8 |
| 2003/0066609 | A1 * | 4/2003 | Calvert | 156/362 |
| 2003/0115997 | A1 * | 6/2003 | Hilliard et al. | 83/325 |
| 2003/0116041 | A1 * | 6/2003 | Manes et al. | 101/198 |
| 2003/0219297 | A1 | 11/2003 | Izawa | |
| 2006/0191426 | A1 * | 8/2006 | Timmerman et al. | 101/24 |
| 2006/0249895 | A1 * | 11/2006 | Kern | 271/182 |
| 2008/0151287 | A1 * | 6/2008 | Birkenfeld et al. | 358/1.15 |
| 2009/0031907 | A1 * | 2/2009 | Eckert et al. | 101/228 |
| 2009/0108043 | A1 * | 4/2009 | Beck et al. | 226/1 |
| 2009/0122106 | A1 * | 5/2009 | Ray | 347/35 |
| 2009/0122107 | A1 * | 5/2009 | Ray et al. | 347/37 |
| 2009/0122126 | A1 * | 5/2009 | Ray et al. | 347/102 |
| 2009/0148620 | A1 * | 6/2009 | Petermann | 427/511 |
| 2009/0189929 | A1 * | 7/2009 | Motojima et al. | 347/2 |
| 2009/0295866 | A1 * | 12/2009 | Ray et al. | 347/40 |
| 2009/0295872 | A1 * | 12/2009 | Ray et al. | 347/50 |
| 2010/0101386 | A1 * | 4/2010 | Jackson et al. | 83/37 |

* cited by examiner

VARIABLE FORMAT WEB PRESS

The present invention is directed to a web press, in particular a variable format book web press, newspaper web press, or periodical web press, and to a control device and a folder particularly for web presses of the type mentioned above.

Web presses are known in principle from the prior art, for example, from standard textbooks on web offset printing. For example, web presses for book printing are known from Wolfgang Walenski, *Der Rollenoffsetdruck,* 1995, pp. 98-103. Web presses of this type for book printing are also known from Helmut Teschner, *Offsetdrucktechnik,* 1997, pp. 10/76-10/82.

Further, web presses for book printing are known from DE 40 30 863 A1 which describes a web-fed rotary press having two consecutive longitudinal folding devices with two formers, the first longitudinal folding device being arranged at a 90-degree rotation with respect to the second longitudinal folding device.

All of the web presses mentioned above are constructed as rotary presses, i.e., in order to apply ink to a paper web, they use rotating impression cylinders in the form of plate cylinders carrying printing plates and in the form of transfer cylinders or blanket cylinders which transfer the ink from the plate cylinder to the paper web. The problem of process-related disadvantages arising from fixed cylinder circumferences has already been mentioned in Helmut Teschner, *Offsetdrucktechnik,* 1997, page 10/76; nevertheless, these rotary web offset presses, that is, web presses having rotating impression cylinders, continue in use.

Accordingly, printing mechanisms as well as folders with fixed cylinder circumferences and, therefore, fixed print sections and print formats are used in prior-art web presses, particularly in book web presses. Since the plate cylinders and transfer cylinders or blanket cylinders have a fixed, defined circumference, the associated folders are also adapted to these fixed circumferences and, therefore, fixed print formats. Therefore, the print formats and printed products that can be produced always remain the same throughout the life of the web press as a result of the fixed circumferences of the cylinders. However, fixed formats of this kind cannot be put to optimum use economically and/or technologically for short runs (e.g., less than 1000 copies) or very short runs (e.g., less than 100 copies). Also, the production cost of printing plates and the setup time for changing printing plates in shorter runs has a much greater impact on the production costs of printed products based on percentage than in large runs (e.g., 1000 copies) of printed products all having the same print format. This applies similarly to newspaper printing and periodical printing with short or very short runs, especially for jobber printers who must provide constantly changing printed products on commission for many customers and publishers.

Accordingly, the demand for printing variable formats such as, for example, in book printing and for short runs (e.g., less than 1000 copies) and very short runs (e.g., less than 100 copies down to one copy, i.e., "print on demand") cannot be met in an economically and/or technologically optimized manner by web presses previously known from the prior art.

It is the object of the present invention to overcome the disadvantages of the prior art. This object is met through the features of claims 1, 32, 33, and 37.

Precisely by simultaneously retaining a web press and devices (including the control apparatus and folder) for roll-fed printing, i.e., printing from a rolled-up and, therefore, practically "endless" paper web, in combination with the technical features of the invention shown in the following for the objects of the invention and embodiments thereof, it can be guaranteed that a large variety of print formats can be printed and/or processed in an economically and/or technologically optimized manner.

A first object of the invention relates to a web press with printing units having printing devices or groups of printing devices for applying ink to a paper web. To begin with, the invention provides that there are no rotating impression cylinders in any of the printing devices or groups of printing devices. It is understood within the meaning of the invention that the printing units for applying ink are also suitable for applying any other type of liquid substance to be applied to a paper web such as, e.g., varnish, liquid glue, dampening solution, or the like. Since all rotating impression cylinders are dispensed with, the invention frees itself from the constraint of fixed cylinder circumferences which always limit print formats to a fraction of the cylinder circumference (1, ½, ⅓, ¼, etc.). The paper web arranged on a roll does not have this limitation because it is practically "endless" —limited only by the width of the paper web—and permits printing of any format sizes. Accordingly, by dispensing with rotating impression cylinders, a variable format web press is made possible which can print a large range of print formats. The print formats of a printed image or printed page on the paper web can differ particularly in length (dimension in the running direction of the paper web) and/or width (dimension in the direction transverse to the paper web), but also in alignment (distance of the printed image from the edge of the paper web, distances between the printed images, angles between the longitudinal edge of the printed image and running direction of the paper web).

In an embodiment or alternative of the invention, the printing devices or groups of printing devices are designed to apply ink to the paper web in a contactless manner. In particular, they can be constructed as devices for applying ink in drops or spray by means of a drop dispensing device or nozzle device, for example, in the form of an inkjet device. In this way, direct contact between the paper web and the printing devices is avoided, and it is possible for ink to be applied to the paper web in different formats.

Other embodiments of the first object of the invention will be described in the following. These embodiments can be provided individually or in combination for further embodiments of the invention, i.e., further development of the invention is made possible in principle by all suitable combinations of the technical features described in the following. The dependent patent claims show possibilities for combining the technical features for embodiments of the first object of the invention.

For example, in one embodiment for the invention a control device is provided for controlling and/or regulating the printing devices or groups of printing devices and for controlling and/or regulating an actuating device of at least one cutting device for cutting at least a portion of the paper web, wherein the control of the actuating device is carried out depending on print format settings for the printing devices or groups of printing devices. This construction of the control device in combination with the first object of the invention—and possibly its further embodiments as described above—yields an especially favorable synergy, particularly for a variable format printing process. It is ensured that the entire printing and processing process is adapted in an optimal manner and in conformity to the print format precisely in that the knowledge of the print format settings for the printing devices or groups of printing devices is used for controlling an actuating device of at least one cutting device in a control device, particularly a shared control device.

Within the meaning of the invention, the control of a device when referred to in the description of the invention may always also comprehend regulation of the device. Conversely, within the meaning of the invention, regulation of a device when referred to in the description of the invention may always also comprehend control of the device.

In the following, frequent reference is also made to the running direction L of the paper web. Within the meaning of the invention, the running direction of the paper web is not defined as a universal fixed plane in space because the paper web executes several changes in direction and possibly also loops as is clearly indicated in the drawings. However, the person skilled in the art will be able to determine a clear spatial direction from the local running direction of the paper web in each particular instance, that is, for every section of the paper web.

In an embodiment of the invention, the control device is designed to control and/or regulate a motorized actuating device of a cutting device with cutting knives. The motorized actuating device can be constructed as a drive motor or servomotor, for example.

In an embodiment of the invention, the control device is designed to control and/or regulate the actuating device subject to pre-stored or pre-calculated control curves. These control curves can define a spatial and/or temporal curve for the operating state of the actuating device, i.e., the operating state or operating parameters (such as pressure, intensity, force, speed, spatial position, clock frequency) of the actuating device can be changed spatially or temporally by means of these control curves.

In an embodiment of the invention, the cutting device is constructed as a rotating cutting device, and the control device for controlling and/or regulating the actuating device is constructed in such a way that the cutting device can be operated at varying angular velocity per revolution.

In an embodiment of the invention, the angular velocity (or tangential component of the rotational velocity in the running direction of the paper web) of the cutting knife when contacting the paper web is equal to the conveying speed of the paper web. Accordingly, the rotational velocity is adapted in such a way per revolution of the rotating cutting device that the cutting knife and the paper web have the same velocity at least during contact with one another, so that there is no relative velocity between the two at the point of contact. This prevents a tearing or picking of the paper web.

In an embodiment of the invention, the printing devices or groups of printing devices have a nozzle device, for example, an inkjet device, for spraying ink on the paper web.

In an embodiment of the invention, the printing devices or groups of printing devices are fixed transverse to the running direction of the paper web during the printing process. Accordingly, in principle, there is no movement of the printing devices or groups of printing devices during the printing process as long as they are actively engaged in the printing process.

In an embodiment of the invention, printing devices or groups of printing devices are mounted so as to be swivelable away from or displaceable out of a printing position. This swiveling or displacement can be used, e.g., for maintenance or for exchanging the printing devices or groups of printing devices.

In an embodiment of the invention, printing devices or groups of printing devices or web guiding elements for guiding the paper web which are adjacent to the printing devices are mounted so as to be displaceable perpendicular to the web plane. This can be used in particular for the relative alignment of the printing devices or groups of printing devices or web guiding elements relative to one another and/or relative to the paper web.

In an embodiment of the invention, printing devices or groups of printing devices or web guiding elements for guiding the paper web which are adjacent to the printing devices are controlled or regulated by a control device so as to be displaceable perpendicular to the web plane in such a way that a predefined distance is maintained between the paper web and the printing devices. In particular, this may be required in printing devices having a nozzle device.

In an embodiment of the invention, the printing devices or groups of printing devices extend transverse to the running direction of the paper web only over part of the width of the paper web, and printing devices are arranged so as to be offset relative to one another transverse to the running direction of the paper web. Typical paper web widths in web presses may be greater than 1 m and sometimes even appreciably greater than 1 m. When the printing devices extend transverse to the running direction of the paper web only over a part of the width of the paper web, but are arranged so as to be offset relative to one another, complicated and expensive full-width printing devices can be dispensed with, but printing is nevertheless carried out over the entire width of the paper web.

In an embodiment of the invention, a plurality of printing devices or groups of printing devices are arranged successively in the running direction of the paper web. This can be used, for example, for printing a plurality of inks successively.

In an embodiment of the invention, printing devices, considered in the running direction of the paper web, overlap transverse to the running direction of the paper web in at least one overlapping area. This makes it possible to print over the entire surface of the paper web transverse to the running direction of the paper web. However, this can also be used, for example, when an area of the paper web along a line transverse to the running direction of the paper web should not, or need not, be actively used for printing transverse to the running direction of the paper web, e.g., because this area will subsequently be hidden or cut off. This area then generally extends over a longer distance in the running direction of the web. No unique, defined printing need then be provided in this area by exactly one printing device; rather, information that has already been printed can be overprinted in this area without a negative effect.

In an embodiment of the invention, printing devices, considered in the running direction of the paper web, are spaced apart from one another transverse to the running direction of the paper web by at least one clearance area. This can be used, for example, when an area of the paper web along a line transverse to the running direction of the paper web should not, or need not, be imprinted, e.g., because this area will subsequently be hidden or cut off. This area then generally extends over a longer distance in the running direction of the web. No overlapping of the printing devices need then be provided for this area; rather, a distance can be provided in this area between the printing devices arranged above it.

In an embodiment of the invention, the at least one overlapping area or the at least one clearance area lies in the area of a fold line. In particular, a fold line of this kind is often an area of the paper web on a line transverse to the running direction of the paper web that should not, or need not, be actively used for printing or which should not, or need not, be printed upon, e.g., because this area will subsequently be hidden or cut off. As a rule, this area or this fold line then extends over a longer distance in the running direction of the web.

In an alternative embodiment of the invention, the printing devices or groups of printing devices extend transverse to the running direction of the paper web over the full width of the paper web in each instance.

In an embodiment of the invention, the individual printing devices of a group of printing devices are constructed, respectively, for applying different inks. Accordingly, while printing devices can print upon the paper web with only one ink in principle, printing devices may also be provided for printing different inks, and certain printing devices for printing different inks are assembled to form a group. These groups are characterized, for example, by a similar spatial arrangement or in that they are controlled in common.

In an embodiment of the invention, the printing devices each have a plurality of segments transverse to the running direction of the paper web for applying different inks. Accordingly, alternatively or in addition to arranging them as groups, the printing devices themselves can also be subdivided structurally or functionally into segments, each of which is designed to apply different ink.

In an embodiment of the invention, at least one dryer is provided downstream of at least one of the printing units in the running direction of the paper web. In particular, heatset production is made possible in this way.

In an embodiment of the invention, the dryer is structurally integrated in a printing unit. A particularly compact structural or spatial arrangement of the printing unit and dryer is made possible in this way.

In an embodiment of the invention, the dryer is structurally or spatially integrated in a printing unit in such a way that dryer operation is prevented from influencing the printing devices. This takes into account the fact that disruptive influences such as heat radiation, vibrations, electromagnetic fields, or the like can emanate from the dryer and influence the functioning of the printing devices. This embodiment of the invention prevents a disruptive influence of the dryer operation on the printing devices, for example, by means of suitable spatial separation or distances, suitable relative spatial arrangement of the dryer and printing devices with respect to one another, or by suitable shielding.

In principle, the dryer can be arranged below the printing devices, for example. In this case, however, depending upon the type and construction of the dryer, there may be a risk of a rise in generated heat and an unwanted heating of the printing devices. Therefore, an embodiment of the invention provides that the dryer is arranged spatially above the printing devices of a printing unit.

In an embodiment of the invention, a folder is arranged downstream of the printing units and has a plurality of folding devices arranged in series or arranged in parallel to one another in the running direction of the paper web. This arrangement of the folder in combination with the first object of the invention—and, as the case may be, with its further embodiments as described above—results in an especially favorable synergy, particularly for a variable format printing process. The two folding devices provide extensive freedom for the design and processing of printed products precisely for variable format printing process.

In an embodiment of the invention, the arrangement of the folding devices and the guiding of the paper web in the folder are effected in such a way that the fold lines already mentioned above each define the fold of the paper web by one of the folding devices. In this way, in particular, areas of the paper web which are not imprinted or which are overprinted can be accurately aligned in such a way that they lie on a fold of the printed products and, therefore, are not disagreeably noticeable in the finished printed product.

In an embodiment of the invention, each folding device is displaceable in at least one spatial direction, the first folding device being displaceable in a first spatial direction and the second folding device being displaceable in a spatial direction perpendicular thereto. In contrast, the prior art according to DE 40 30 863 A1 provides for a displacement of only one of two formers, the other former being fixed. Accordingly, this embodiment of the invention offers an improved freedom in the orientation and adaptation of the folding devices to a wide variety of print formats and paper web widths or paper web guidance. In particular, this ensures that the post-processing equipment (cutting devices, web or sheet guides, grippers, etc.) arranged downstream in the running direction of the paper web requires little or no adjustment (e.g., spatial displacement) to changed print formats and paper web widths or paper web guidance. Rather, such adjustment can be implemented by displacement of the folding devices.

In an embodiment of the invention, the at least one folding device is additionally also displaceable in the second spatial direction or in a third spatial direction perpendicular to the first spatial direction. This adjustability of the one folding device further facilitates adaptation with respect to the alignment and adaptation of the folding devices to a wide variety of print formats and paper web widths or paper web guidance. For example, a symmetric or asymmetric guiding of the paper web through the printing devices can also be compensated by the displaceability on two axes accompanied by a variability of the web widths and print formats. This ensures that the post-processing equipment (cutting devices, web or sheet guides, grippers, etc.) arranged downstream in the running direction of the paper web requires little or no adjustment (e.g., spatial displacement) to changed print formats and paper web widths or paper web guidance.

In an embodiment of the invention, the folder has a paper sheet transporting element with a drive, and the drive is regulated by the control device or by a separate control device in such a way that paper sheets severed from the paper web by the cutting device are accelerated away from the rest of the paper web in the running direction of the paper web. In this way, in particular, paper sheets severed from the paper web are spatially separated by a defined amount from the rest of the paper web, or from subsequently severed paper sheets, downstream of the cutting device. Therefore, these paper sheets can be separately acquired and/or processed more easily in post-processing equipment.

In an embodiment of the invention, a device with a drive is arranged downstream of the paper sheet transporting element, and the drive is regulated by the control device or by a separate control device in such a way that the transporting movement of the previously accelerated paper sheets is slowed down. In this way, in particular, separated paper sheets can be gathered, e.g., in order to generate products in multiple layers.

In an embodiment of the invention, the above-mentioned device is constructed in such a way that at least a portion of the paper sheets, in addition to being slowed down, is lifted or lowered for shingling the paper sheets. Lifting or lowering at least a portion of the paper sheets in this way, for example, the front edge or rear edge (considered in the running direction of the paper web), facilitates shingling of the paper sheets because succeeding paper sheets are then guided over or under the preceding paper sheets.

An embodiment of the invention provides a web turner device which is arranged downstream of the printing units and which has a plurality of longitudinal cutters for dividing the paper web into web sections, and post-processing equipment without a former which has a cutting module for severing paper sheets from the rest of the paper web and a delivery module for gathering and/or delivering and/or shingling the paper sheets.

Accordingly, formers—and possibly also other folding devices—can be omitted in this embodiment because the required product width is already achieved by cutting the paper web into web sections and the required product length is produced by the cutting module for severing paper sheets. In the adjoining delivery module, the paper sheets generated in this way can be gathered to form products, shingled and/or delivered. This affords a possibility for a very simple cooperation between the printing units described above and a web turner device and post-processing equipment.

Another object of the invention is a variable format book printing web press, a variable format newspaper printing web press, or a variable format periodical printing web press which can be constructed or further developed particularly according to one or more of the technical features described above, having inkjet printing devices or groups of inkjet printing devices and a control device for controlling and/or regulating the inkjet printing devices or groups of inkjet printing devices and for controlling and/or regulating an actuating device of at least one cutting device, wherein the control of the actuating device is carried out as a function of print format settings for the inkjet printing devices or groups of inkjet printing devices. Inkjet printing devices are printing devices which do not have rotating impression cylinders and are at the same time printing devices or groups of printing devices for applying ink to the paper web in a noncontacting manner. The present embodiment of the control device for controlling inkjet printing devices or groups of inkjet printing devices and for controlling an actuating device of at least one cutting device results in an especially favorable synergy particularly for a variable format printing process. It is ensured that the entire printing and processing process is adapted in an optimal manner and in conformity to the print format precisely in that the knowledge of the print format settings for the inkjet printing devices or groups of inkjet printing devices is used for controlling an actuating device of at least one cutting device in a control device, particularly a shared control device. By variable format web presses is meant within the meaning of the invention that the print format settings of printed pages and/or printed images on the paper web—particularly with respect to length (dimension in the running direction of the paper web) and/or width (dimension in direction transverse to the paper web) and/or alignment (distance of the printed image from the edge of the paper web, distances between the printed images, angles between the longitudinal edge of the printed image and the running direction of the paper web)—can be varied extensively, limited substantially only by the width of the paper web employed.

Another object of the invention is a control device for controlling and/or regulating printing devices or groups of printing devices which can be constructed or further developed particularly according to one or more of the technical features described above. The control device is also designed to control and/or regulate an actuating device of at least one cutting device for cutting at least a portion of the paper web, this control and/or regulation of the actuating device being carried out as a function of print format settings for the printing devices or groups of printing devices. This construction of the control device results in an especially favorable synergy, particularly for a variable format printing process. It is ensured that the entire printing and processing process is adapted in an optimal manner and in conformity to the print format precisely in that the knowledge of the print format settings for the printing devices or groups of printing devices is used for controlling an actuating device of at least one cutting device in a control device, particularly a shared control device.

Embodiments of the other object of the invention will be described in the following. These embodiments can be provided individually or in combination for further embodiments of the invention, i.e., further development of the invention is made possible in principle by all suitable combinations of the technical features described in the following. The dependent patent claims show a possibility for combining the technical features for embodiments of the other object of the invention.

In an embodiment of the invention, the control device is designed to control and/or regulate a motorized actuating device of a cutting device with cutting knives. The motorized actuating device can be constructed as a drive motor or servomotor, for example.

In an embodiment of the invention, the control device is designed to control and/or regulate the actuating device as a function of pre-stored or pre-calculated control curves. These control curves can define a spatial and/or temporal curve for the operating state of the actuating device, i.e., the operating state or operating parameters (such as pressure, intensity, force, speed, spatial position, clock frequency) of the actuating device can be changed spatially or temporally by means of these control curves.

In an embodiment of the invention, the control device is designed to control and/or regulate the actuating device of a rotating cutting device, and the control device is designed to control and/or regulate the actuating device in such a way that the cutting device can be operated at varying angular velocity per revolution.

In an embodiment of the invention, the angular velocity (or the tangential component of the rotational velocity in the running direction of the paper web) of the cutting knife when contacting the paper web is equal to the conveying speed of the paper web. Accordingly, the rotational velocity is adjusted in such a way per revolution of the rotating cutting device that the cutting knife and the paper web have the same velocity at least during contact between the cutting knife and paper web, so that there is no relative velocity between them at the point of contact. This prevents tearing or picking of the paper web.

Another object of the invention is a folder, particularly for use with a web press and/or a control device according to one or more of the technical features described above. In an embodiment of the invention, an actuating device of a rotating cutting device can be controlled by a control device in such a way that the cutting device can be operated at varying angular velocity per revolution. In an embodiment of the invention, the angular velocity during contact between the cutting knife and the paper web is equal to the conveying speed of the paper web. Accordingly, the rotational velocity is adjusted in such a way per revolution of the rotating cutting device that the cutting knife and the paper web have the same velocity at least during contact between the cutting knife and paper web, so that there is no relative velocity between them at the point of contact. This prevents tearing or picking of the paper web.

Embodiments of the other object of the invention will be described in the following. These embodiments of the other object of the invention can be provided individually or in combination, i.e., further development of the invention is made possible in principle by all suitable combinations of the technical features described. The patent claims show a possibility for combining the technical features for embodiments of the other object of the invention.

In an embodiment of the invention, the folder has a paper sheet transporting element with a drive, and the drive is regulated by the above-mentioned control device or by a separate control device in such a way that paper sheets severed from the paper web by the cutting device are accelerated away from the rest of the paper web in the running direction of the paper web. In this way, in particular, paper sheets severed from the paper web are spatially separated by a defined amount from the rest of the paper web, or from subsequently severed paper sheets, downstream of the cutting device. Therefore, these paper sheets can be separately acquired and/or processed more easily in post-processing equipment.

In an embodiment of the invention, a plurality of folding devices are arranged in series or are arranged parallel to one another in the running direction of the paper web. The two folding devices provide extensive freedom for designing and processing printed products precisely for variable format printing processes.

In an embodiment of the invention, every folding device is displaceable in at least one spatial direction, the first folding device being displaceable in a first spatial direction and the second folding device being displaceable in a spatial direction perpendicular thereto. In contrast, in the prior art according to DE 40 30 863 A1 only one of two formers is displaceable, while the other former is fixed. Accordingly, this embodiment of the invention offers improved freedom in the orientation and adaptation of the folding devices to a wide variety of print formats and paper web widths or paper web guidance. In particular, this ensures that the post-processing equipment (cutting devices, web or sheet guides, grippers, etc.) arranged downstream in the running direction of the paper web requires little or no adjustment (e.g., spatial displacement) to changed print formats and paper web widths or paper web guidance. Rather, such adjustment can be implemented by displacement of the folding devices.

In an embodiment of the invention, the at least one folding device is additionally also displaceable in the second spatial direction or in a third spatial direction perpendicular to the first spatial direction. This adjustability of the one folding device further facilitates adaptation with respect to the alignment and adaptation of the folding devices to a wide variety of print formats and paper web widths or paper web guidance. For example, a symmetric or asymmetric guiding of the paper web through the printing devices can also be compensated by the displaceability on two axes, accompanied by a variability of the web widths and print formats. This ensures that the post-processing equipment (cutting devices, web or sheet guides, grippers, etc.) arranged downstream in the running direction of the paper web requires little or no adjustment (e.g., spatial displacement) to changed print formats and paper web widths or paper web guidance.

In an embodiment of the invention, a device with a drive is arranged downstream of the paper sheet transporting element, and the drive is regulated in such a way by the control device mentioned above or by a separate control device that the transporting movement of the previously accelerated paper sheets is slowed down. In this way, in particular, separated paper sheets are gathered, e.g., in order to generate products comprising multiple layers.

In an embodiment of the invention, the above-mentioned device is constructed in such a way that at least a portion of the paper sheets, in addition to being slowed down, is lifted or lowered for shingling the paper sheets. Lifting or lowering at least a portion of the paper sheets in this way, for example, the front edge or rear edge (considered in the running direction of the paper web), facilitates shingling of the paper sheets because succeeding paper sheets are then guided over or under the preceding paper sheets.

An embodiment of the invention provides a web turner device which is arranged downstream of the printing units and which has a plurality of longitudinal cutters for dividing the paper web into web sections, and post-processing equipment without a former which has a cutting module for severing paper sheets from the rest of the paper web and a delivery module for gathering and/or delivering and/or shingling the paper sheets.

Accordingly, formers—and possibly also other folding devices—can be omitted in this embodiment because the required product width is already achieved by cutting the paper web into web sections and the required product length is produced by the cutting module for severing paper sheets. In the adjoining delivery module, the paper sheets generated in this way can be gathered to form products, shingled and/or delivered. This affords a possibility for a very simple cooperation between the printing units described above and a web turner device and post-processing equipment.

Figure 2:
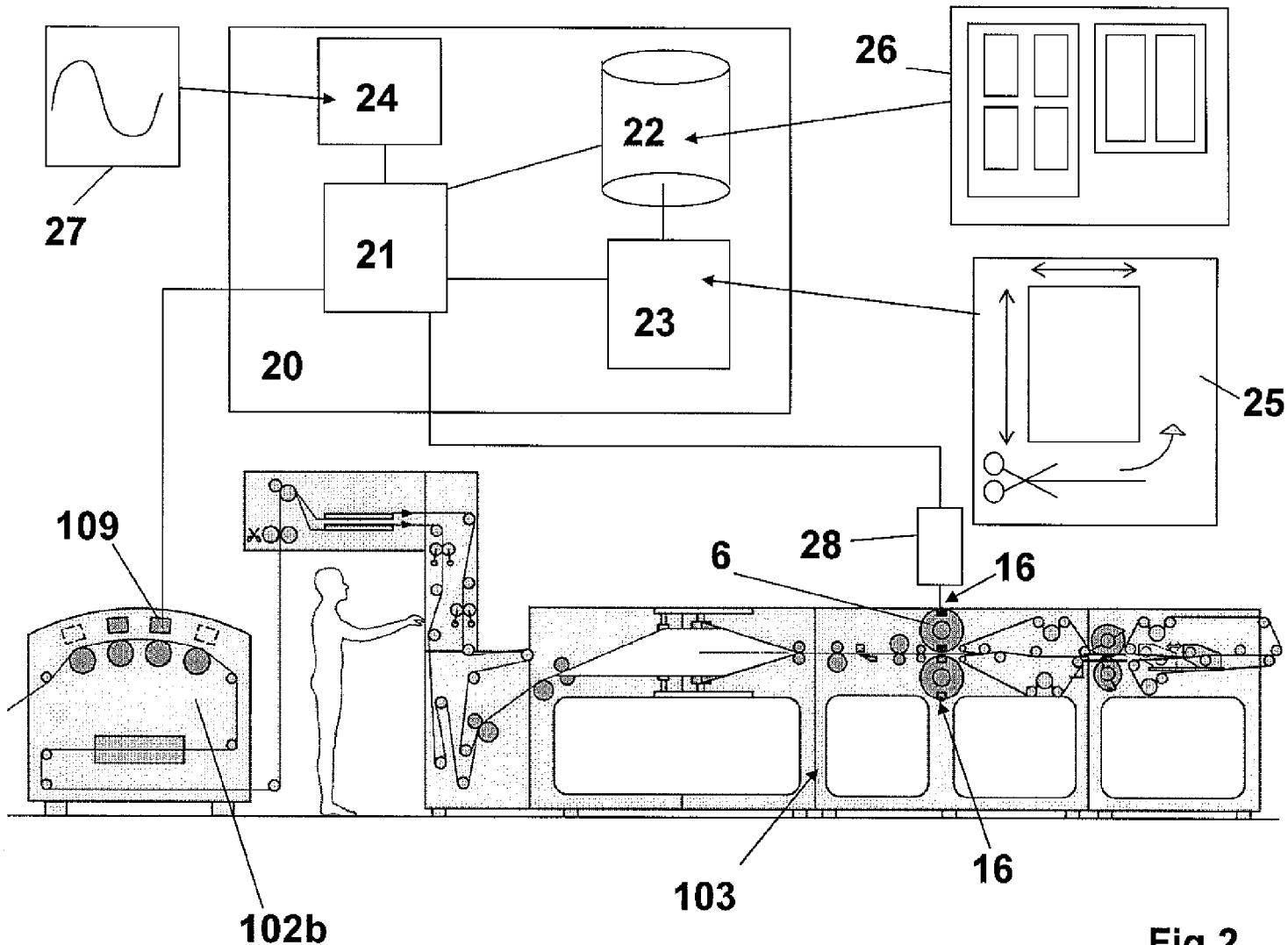
Figure 3:
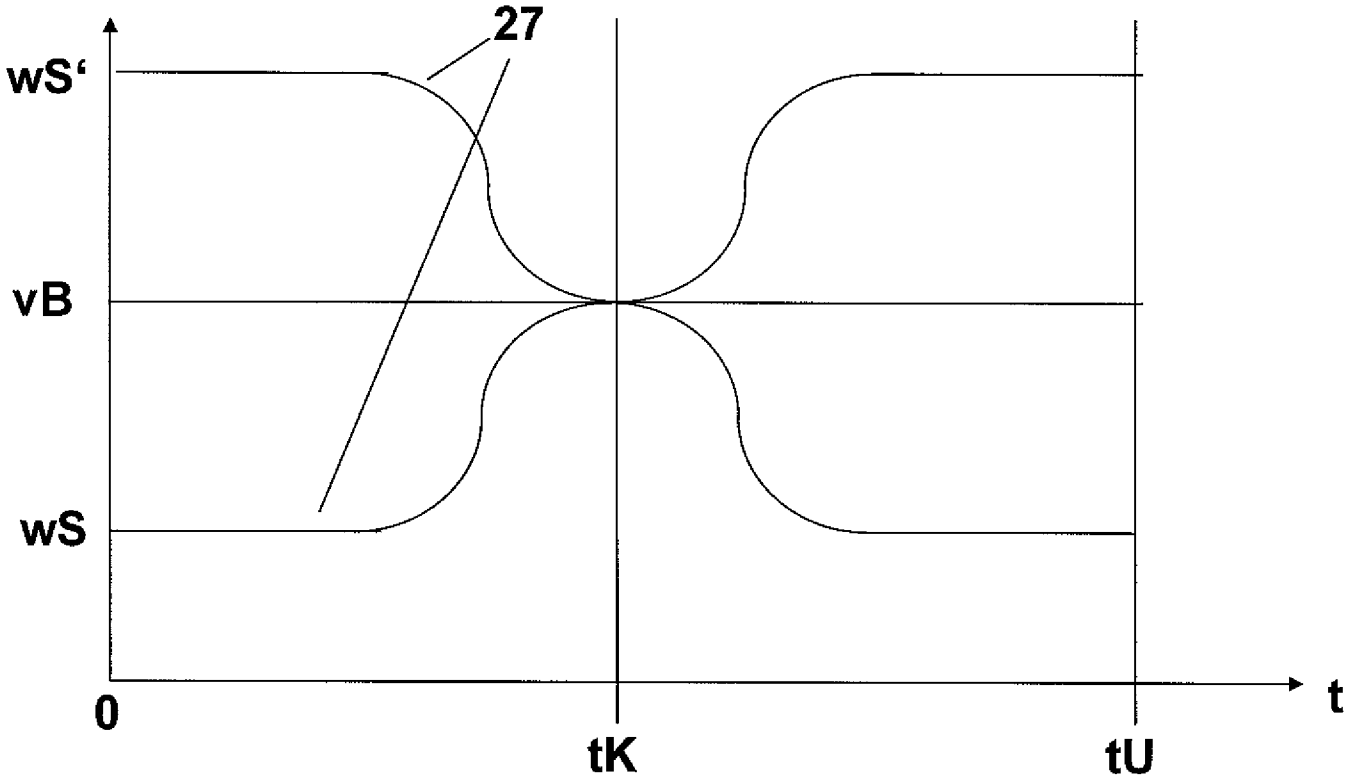
Figure 4:
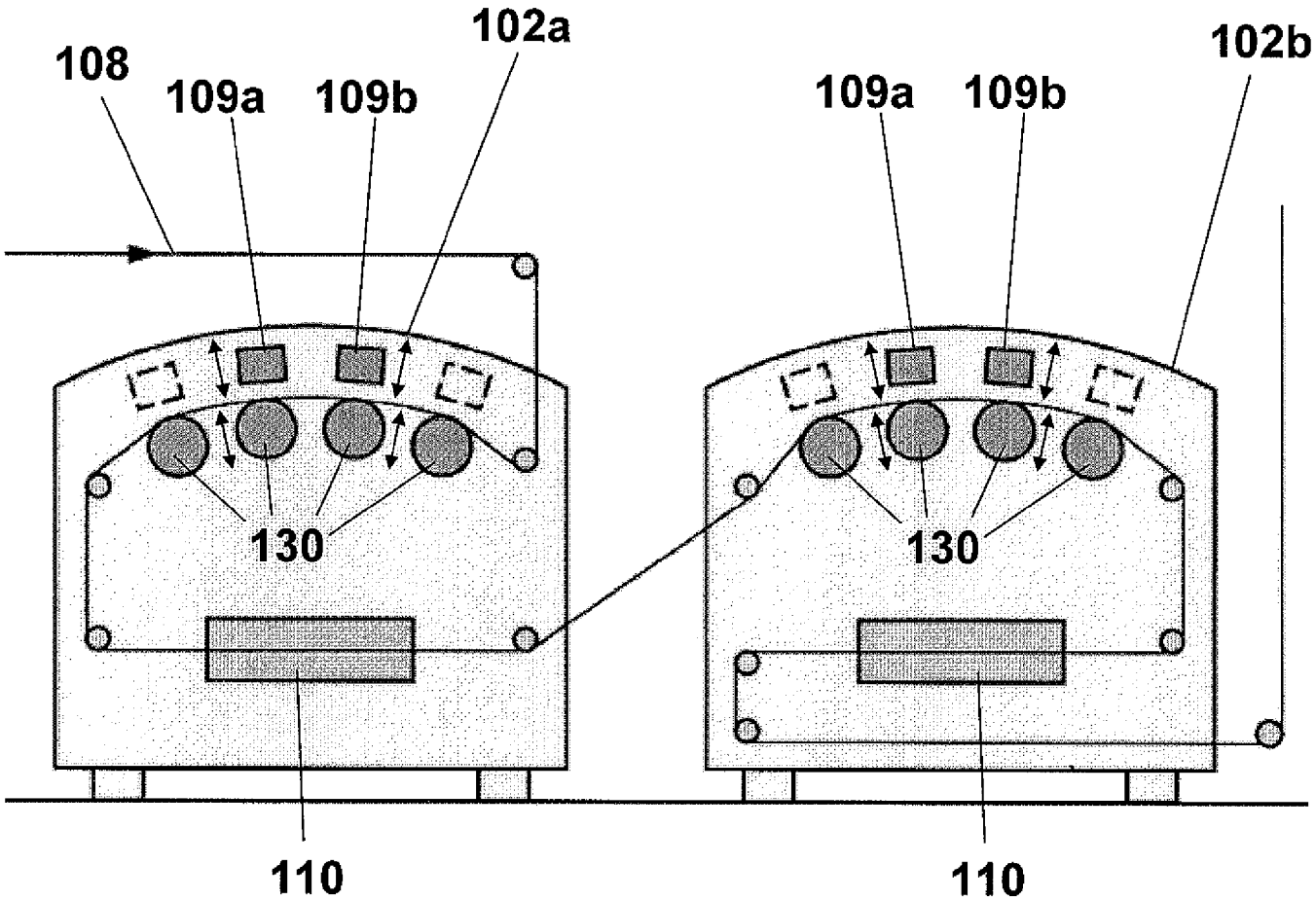
Figure 5:
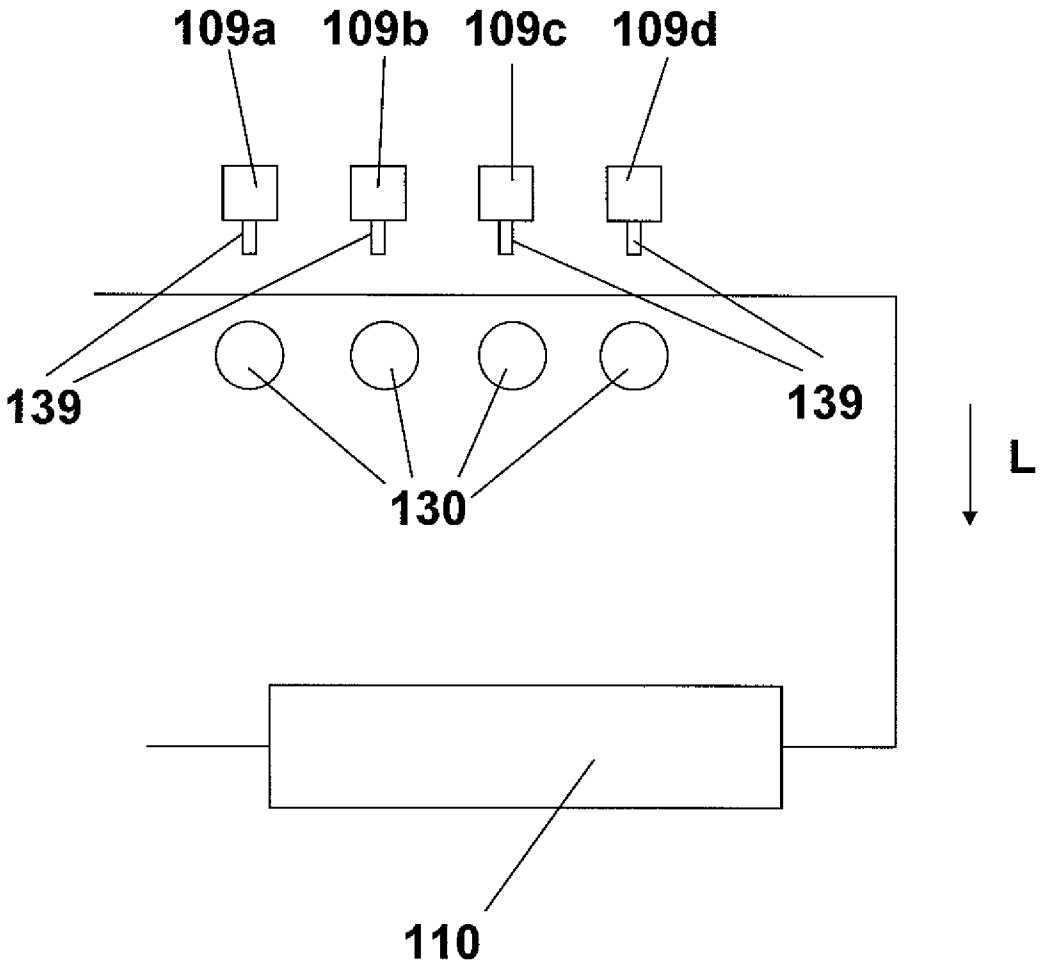
Figure 6:
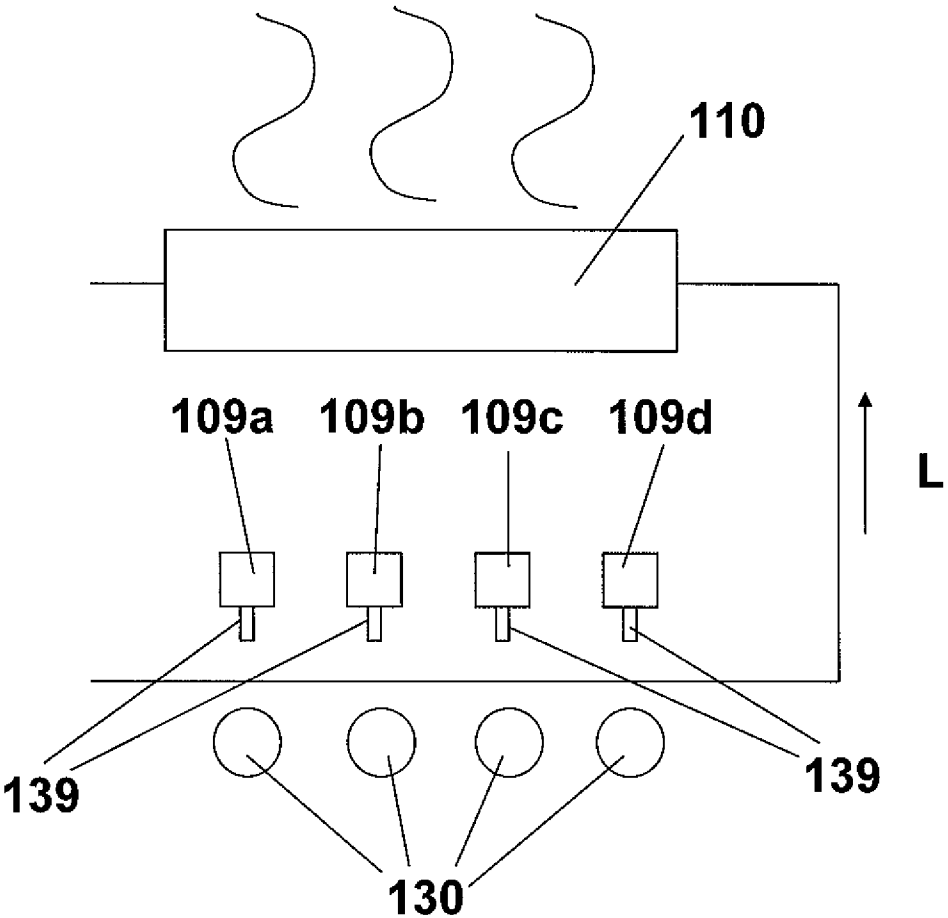
Figure 7:
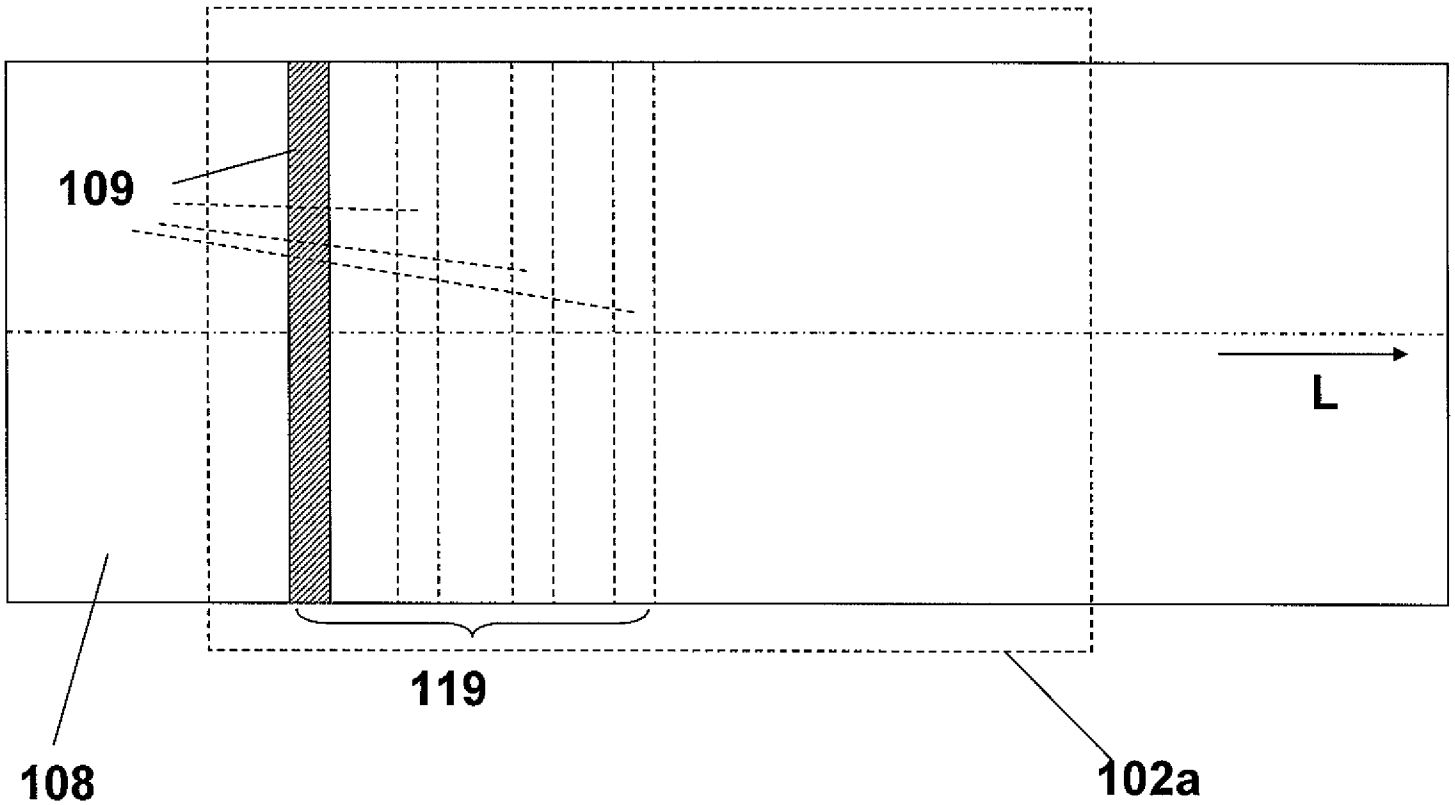
Figure 8:
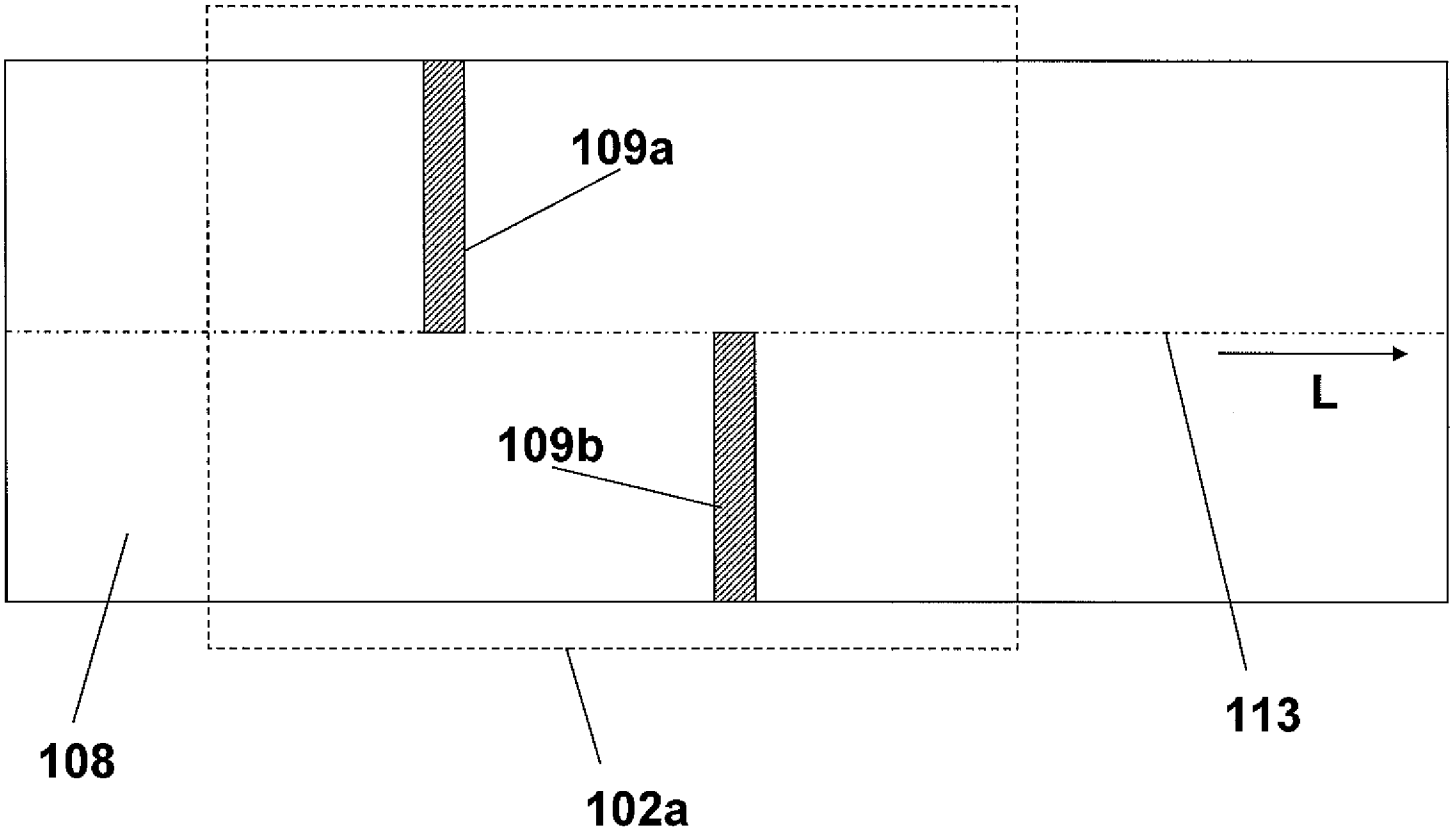
Figure 9:
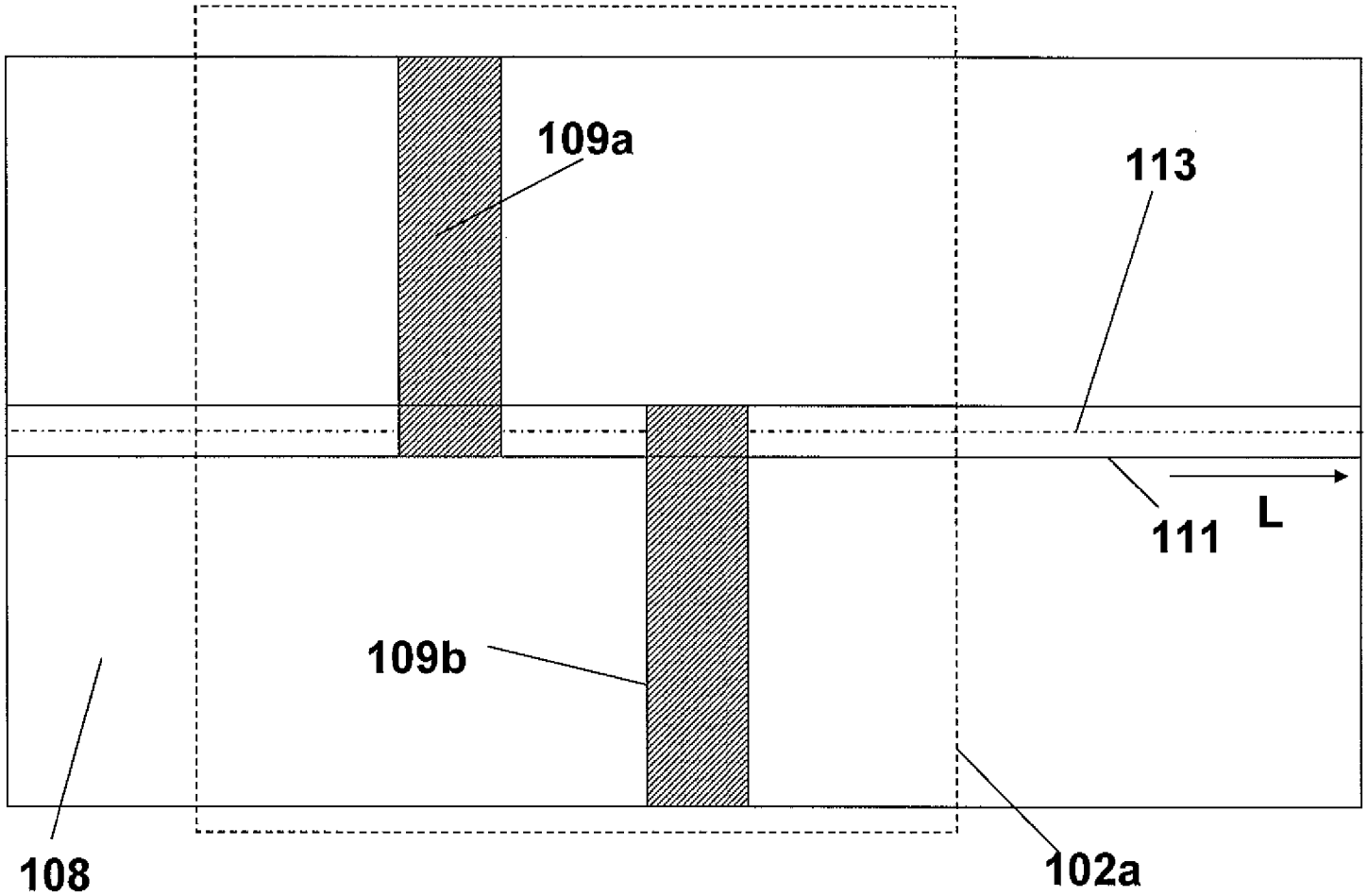
Figure 10:
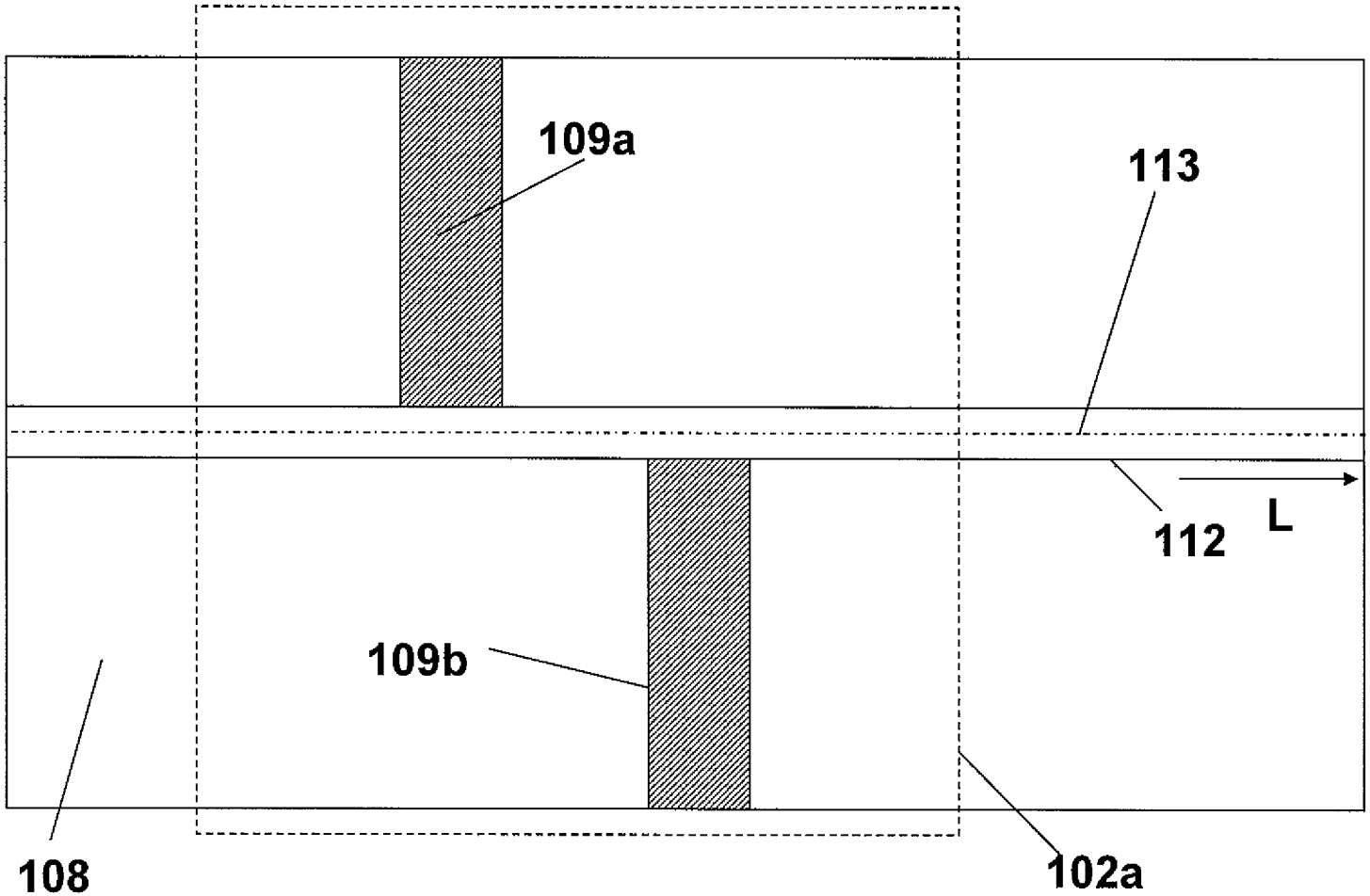
Figure 11:
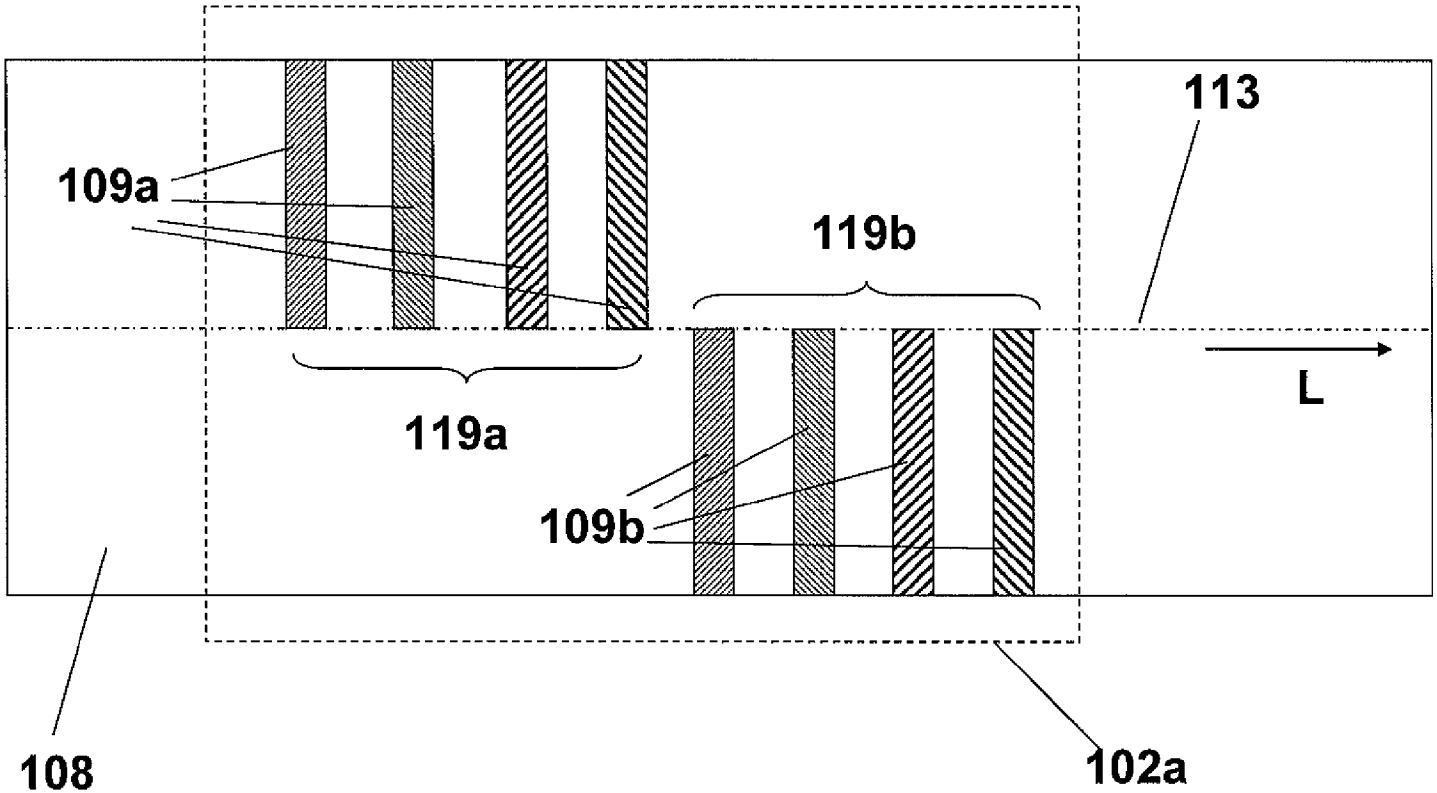
Figure 12:
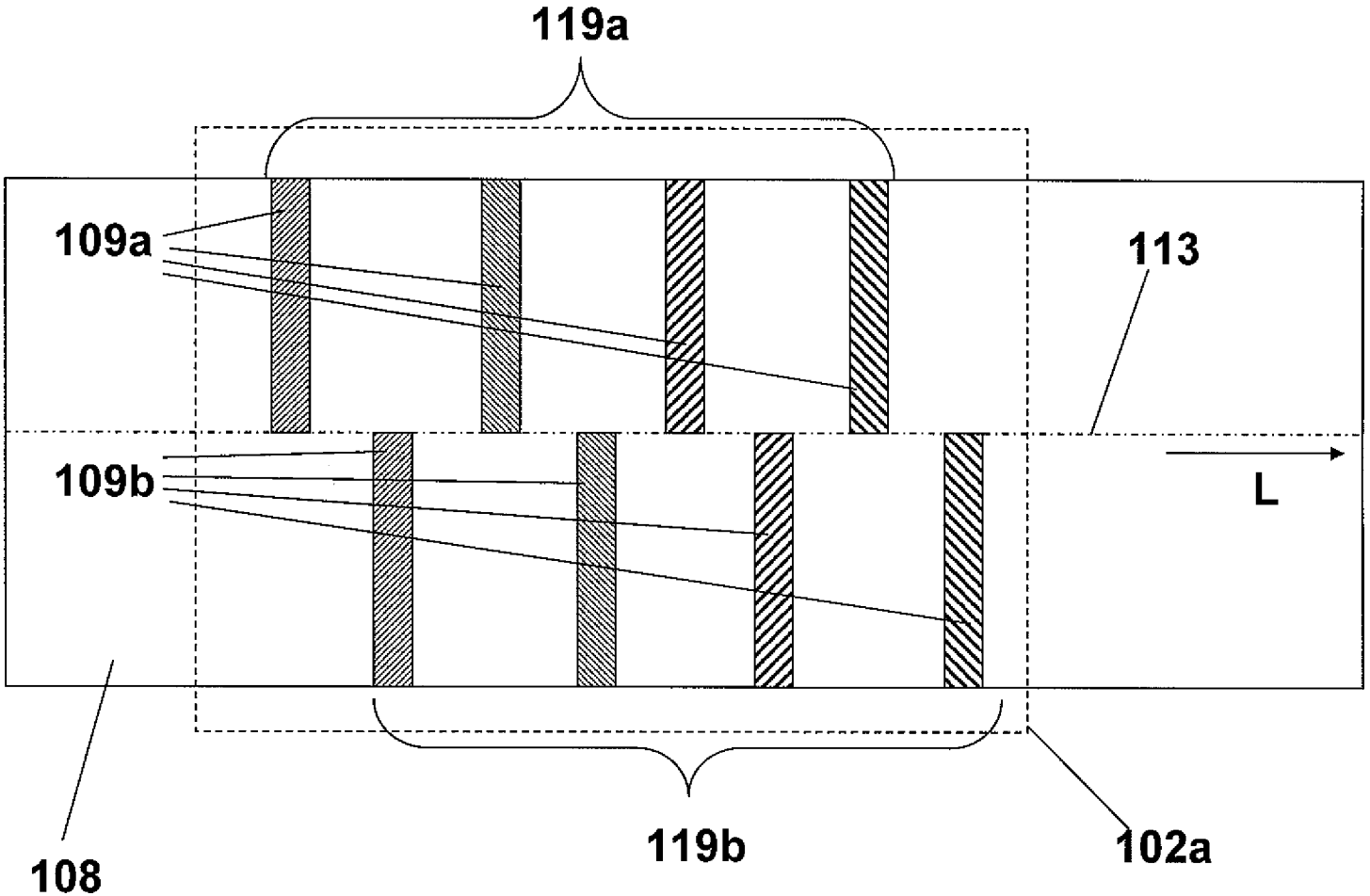
Figure 13:
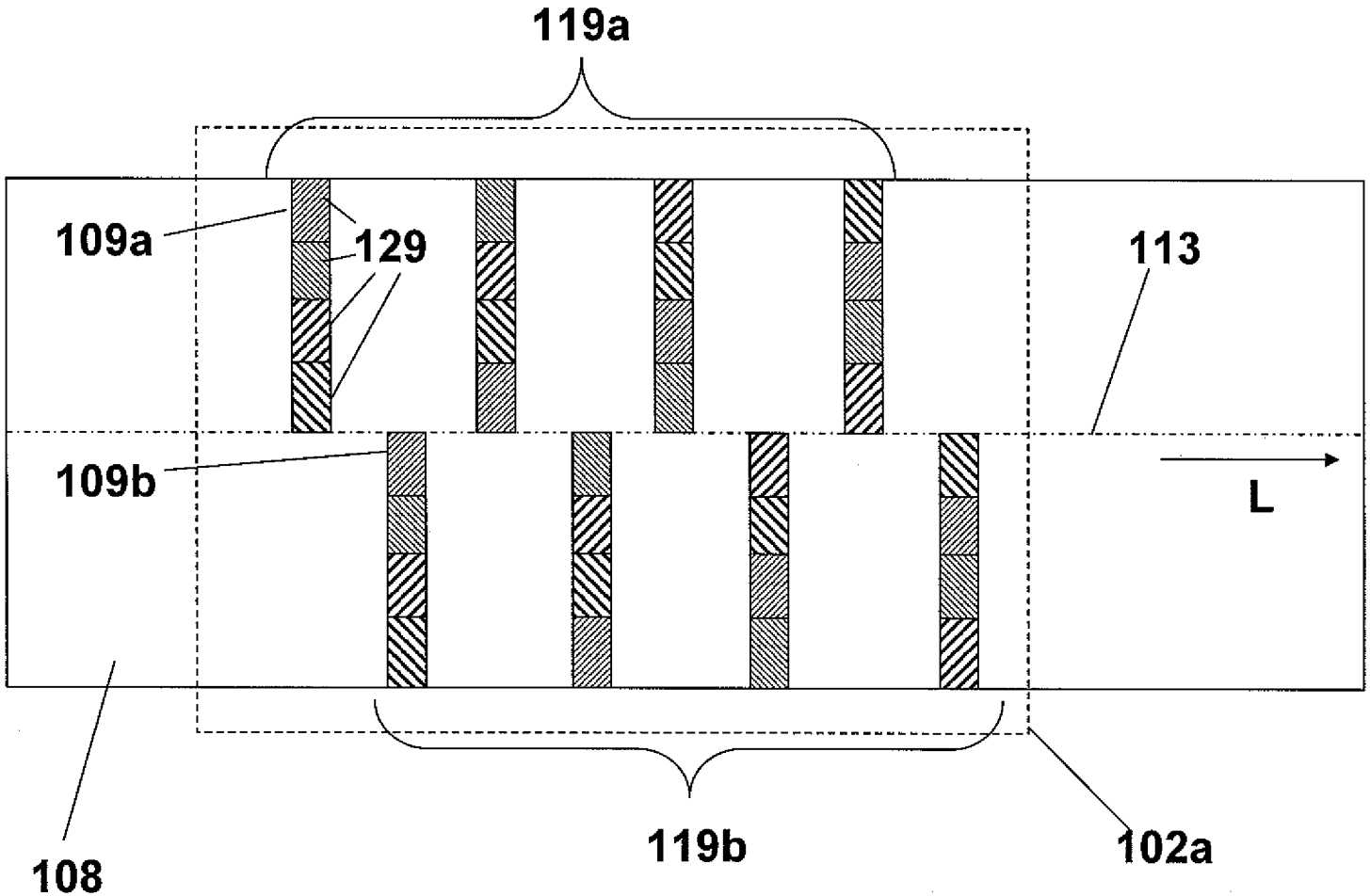
Figure 14:
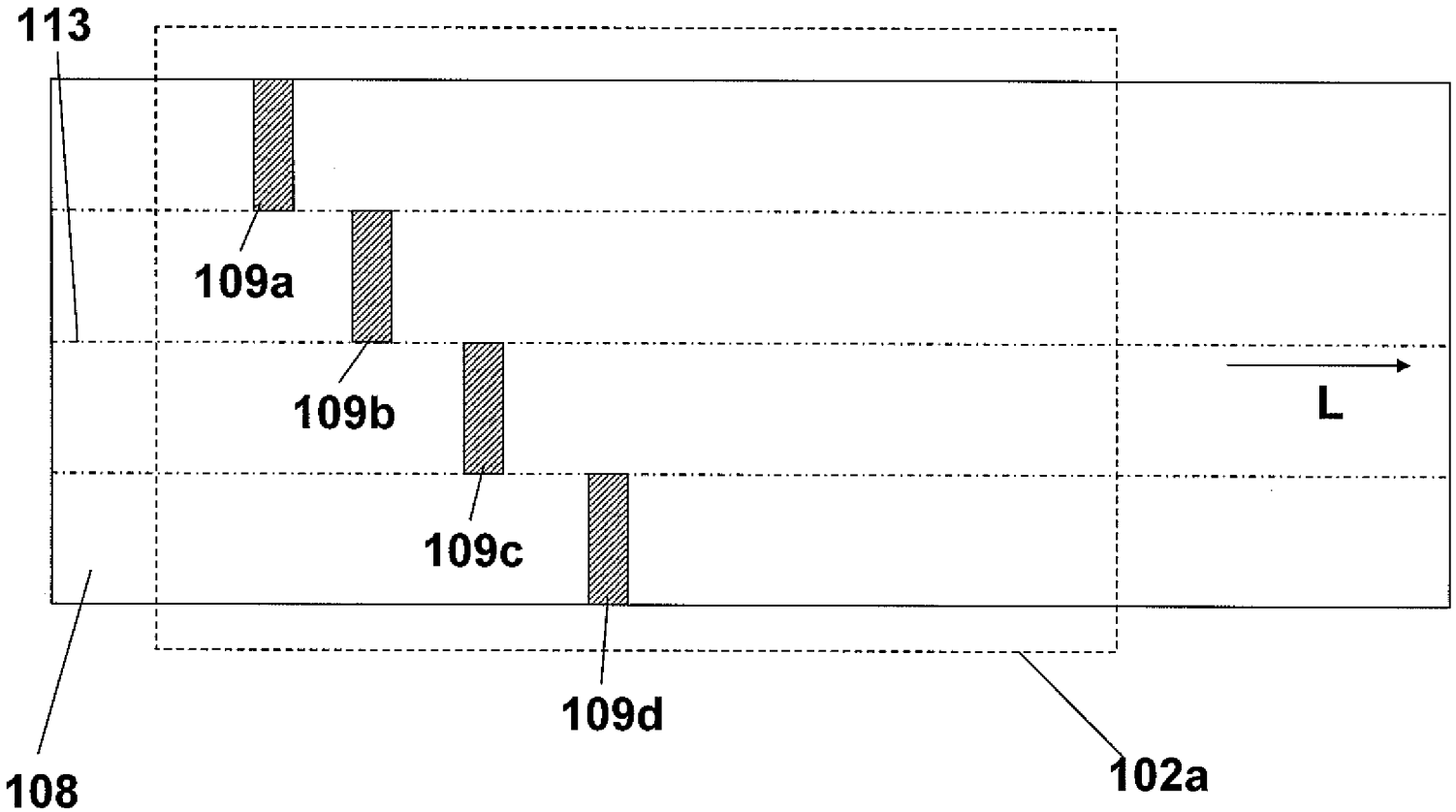
Figure 15:
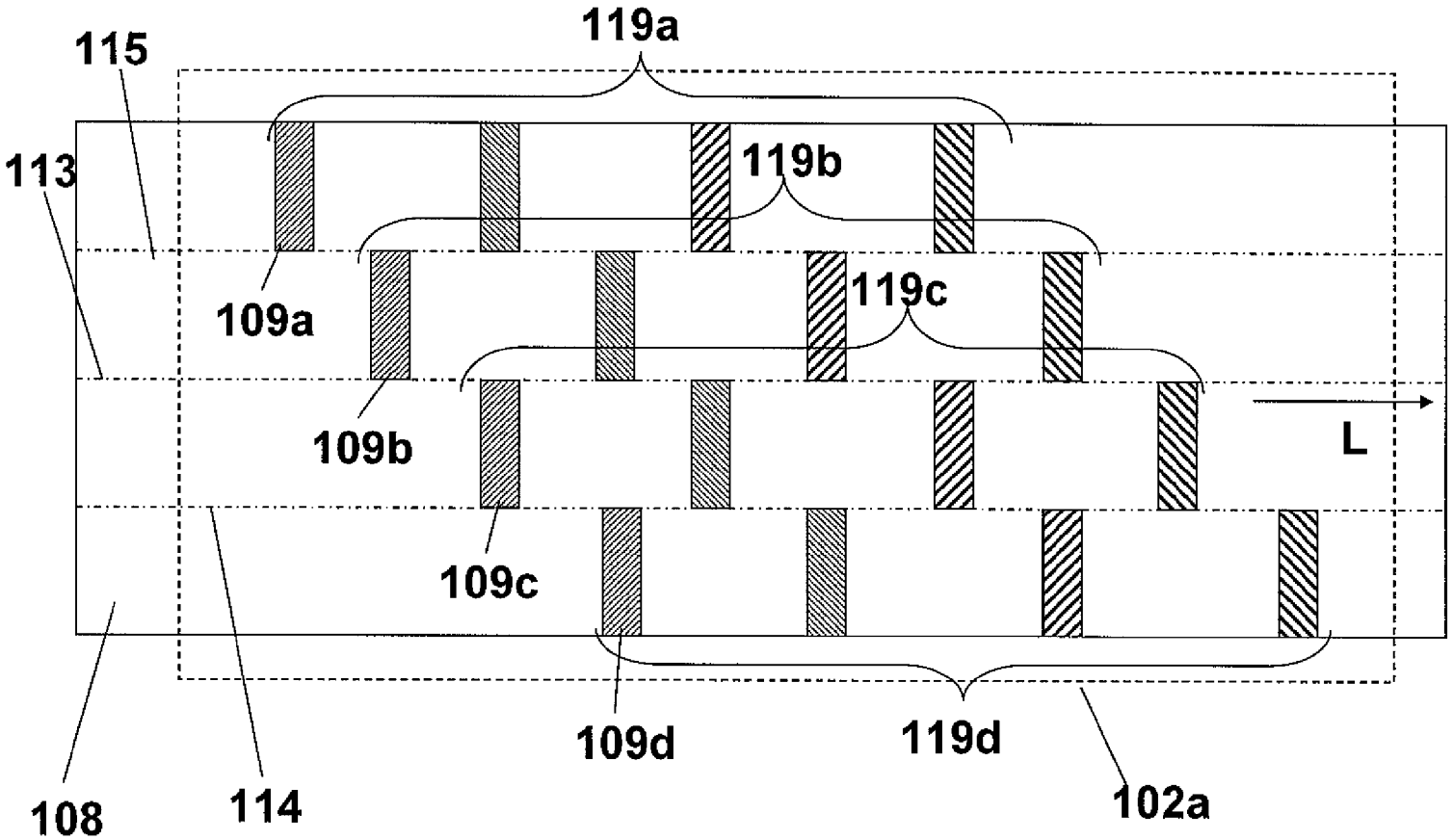
Figure 16:
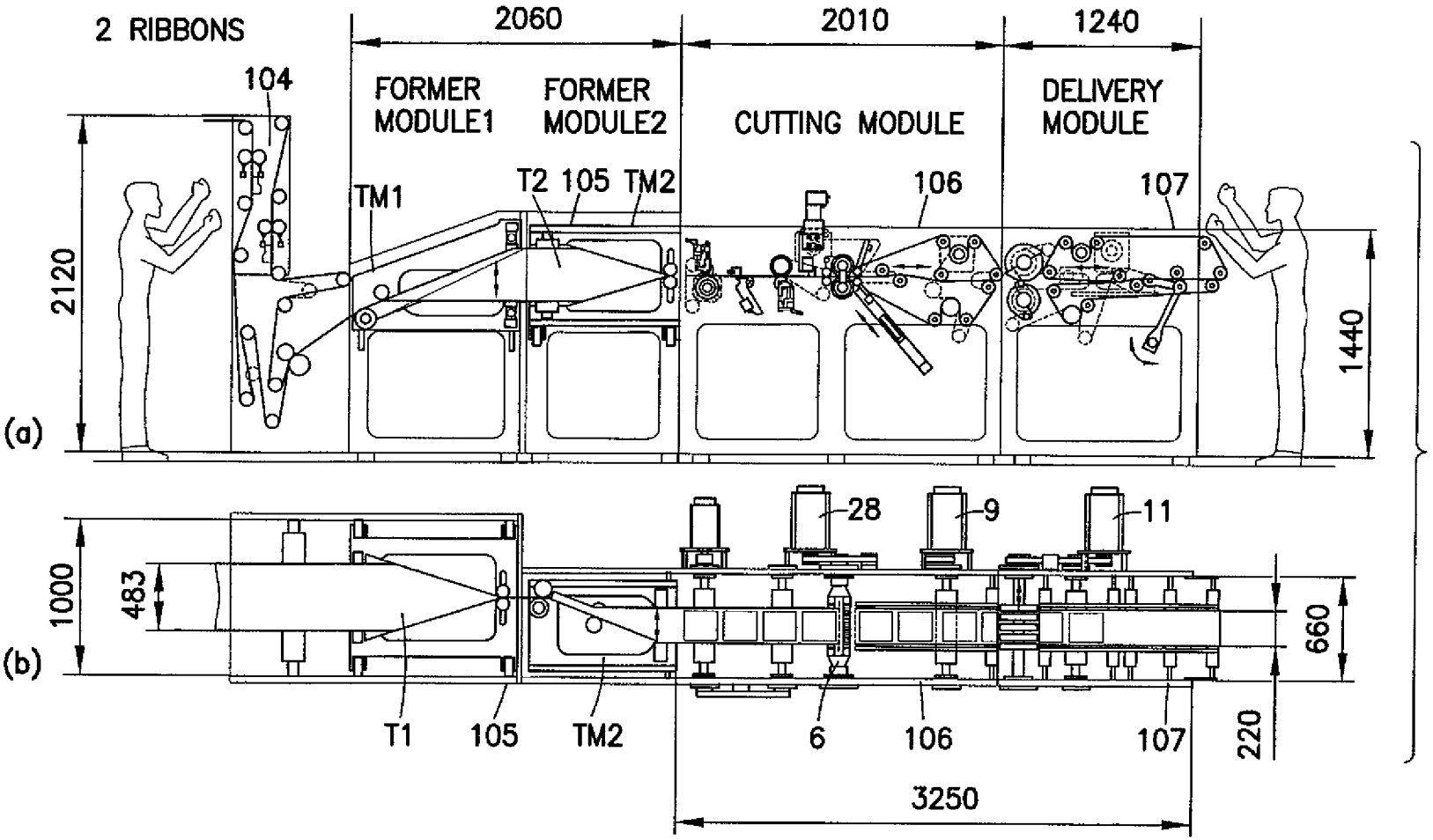
Figure 17:
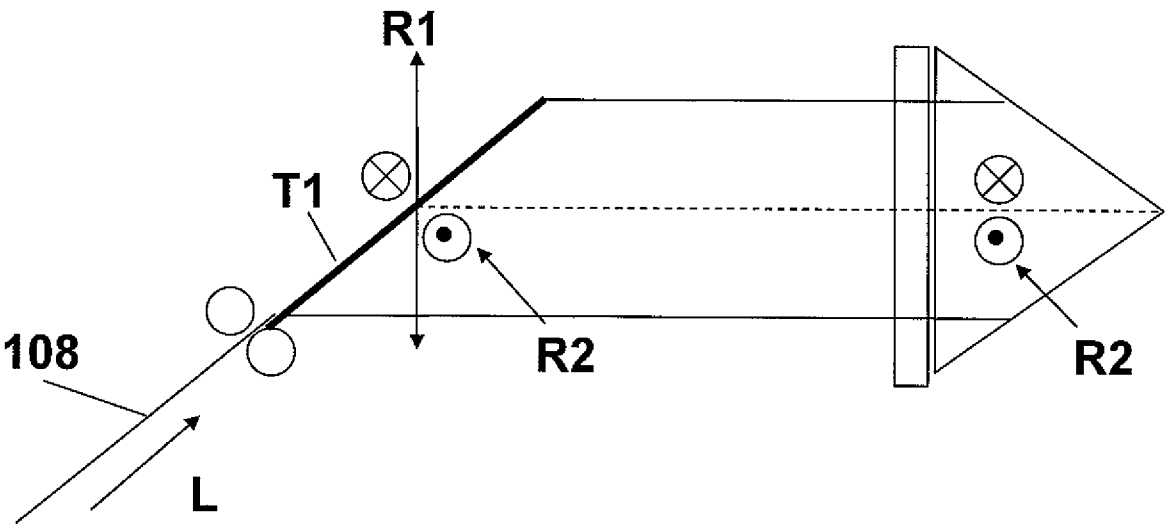
Figure 18:
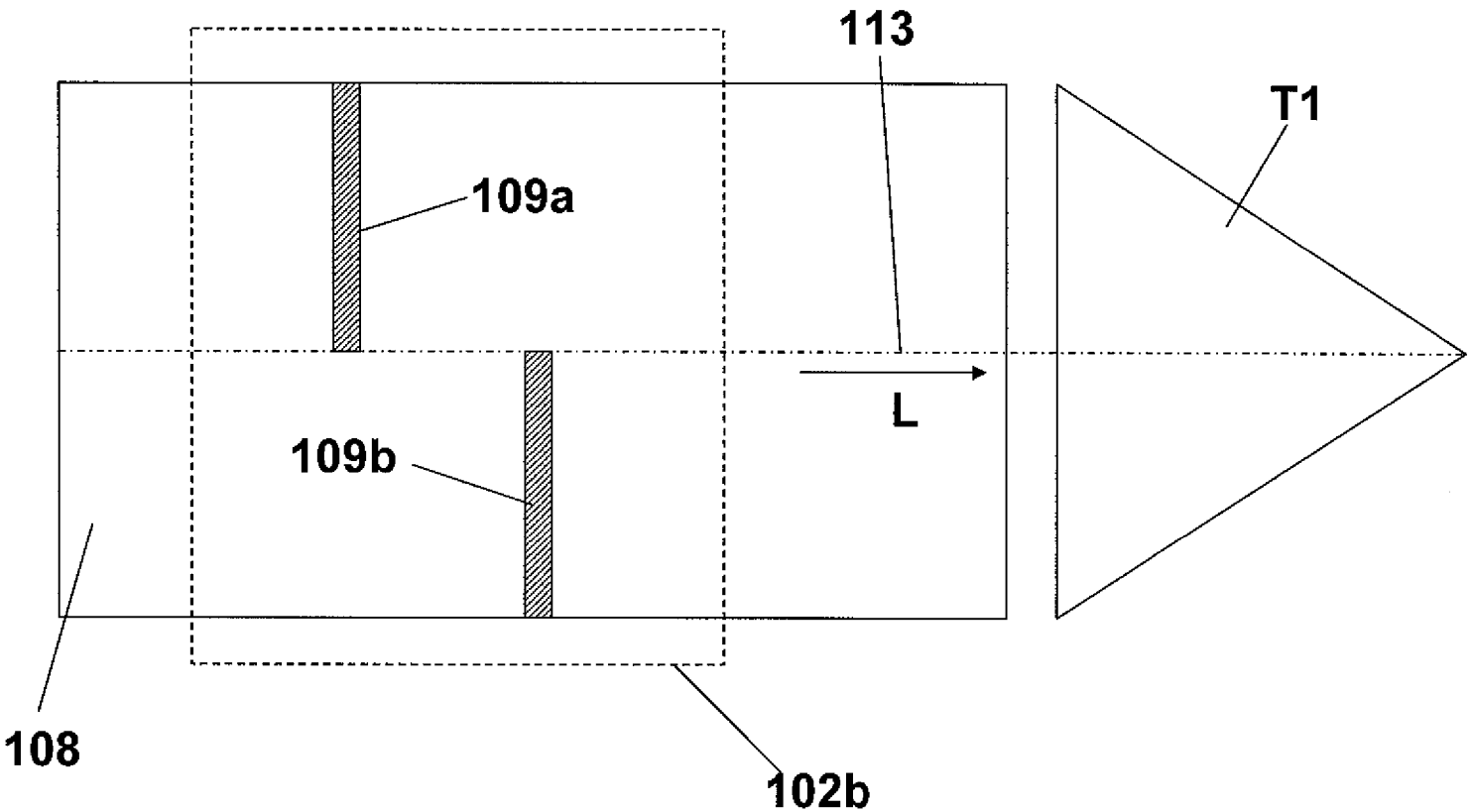
Figure 19:
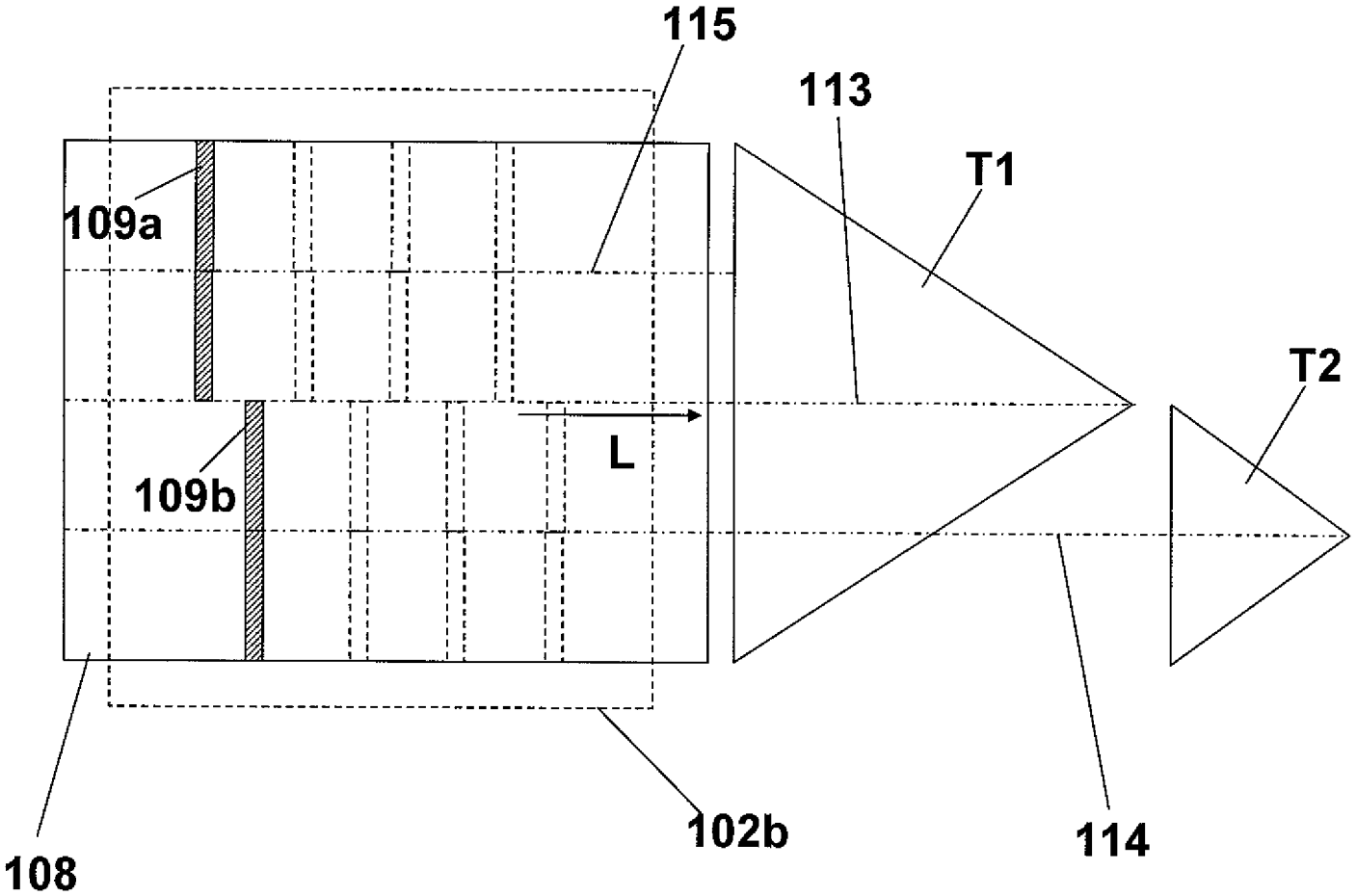
Figure 20:
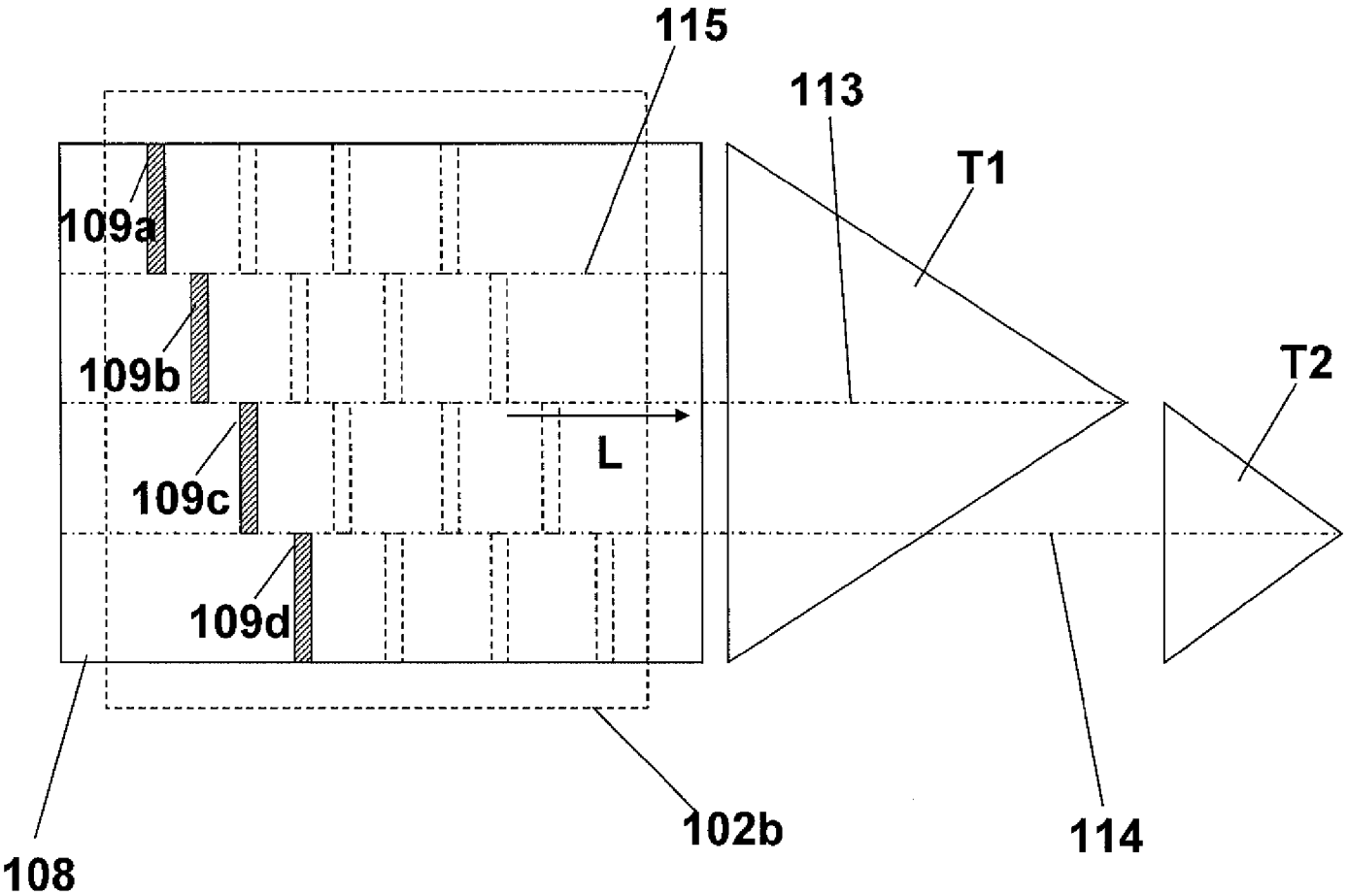
Figure 21:
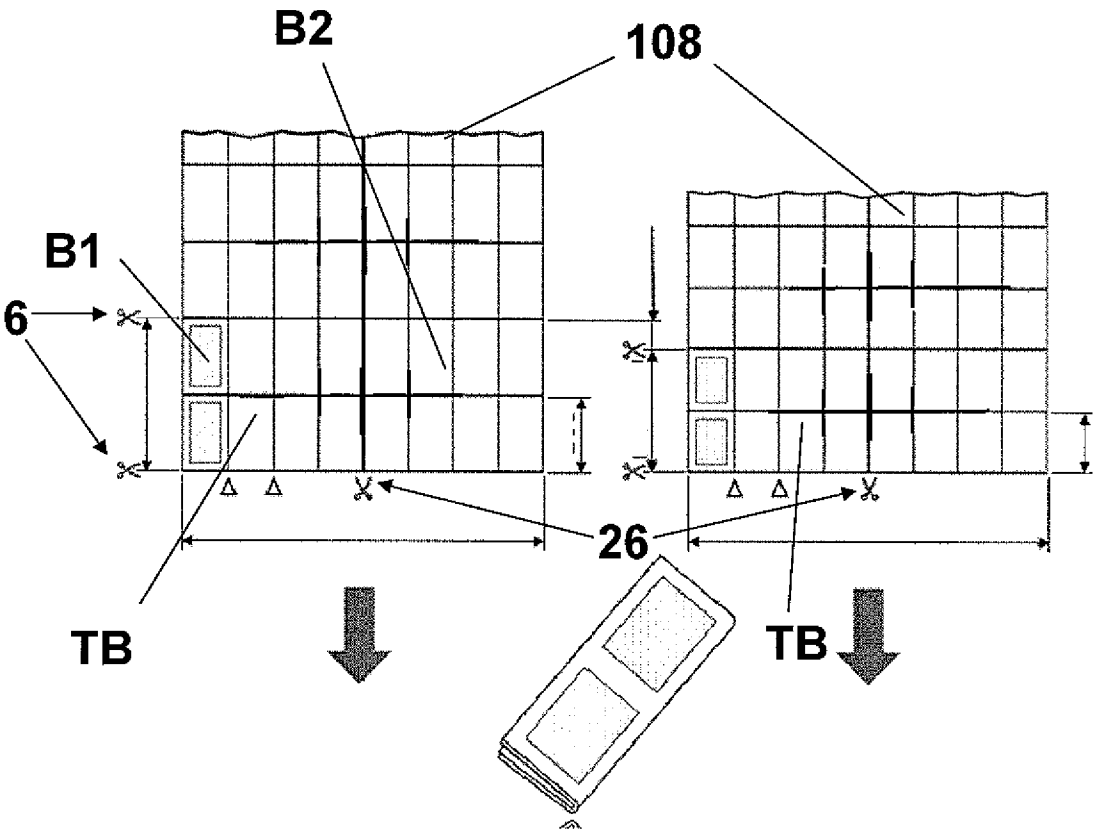
Figure 22:
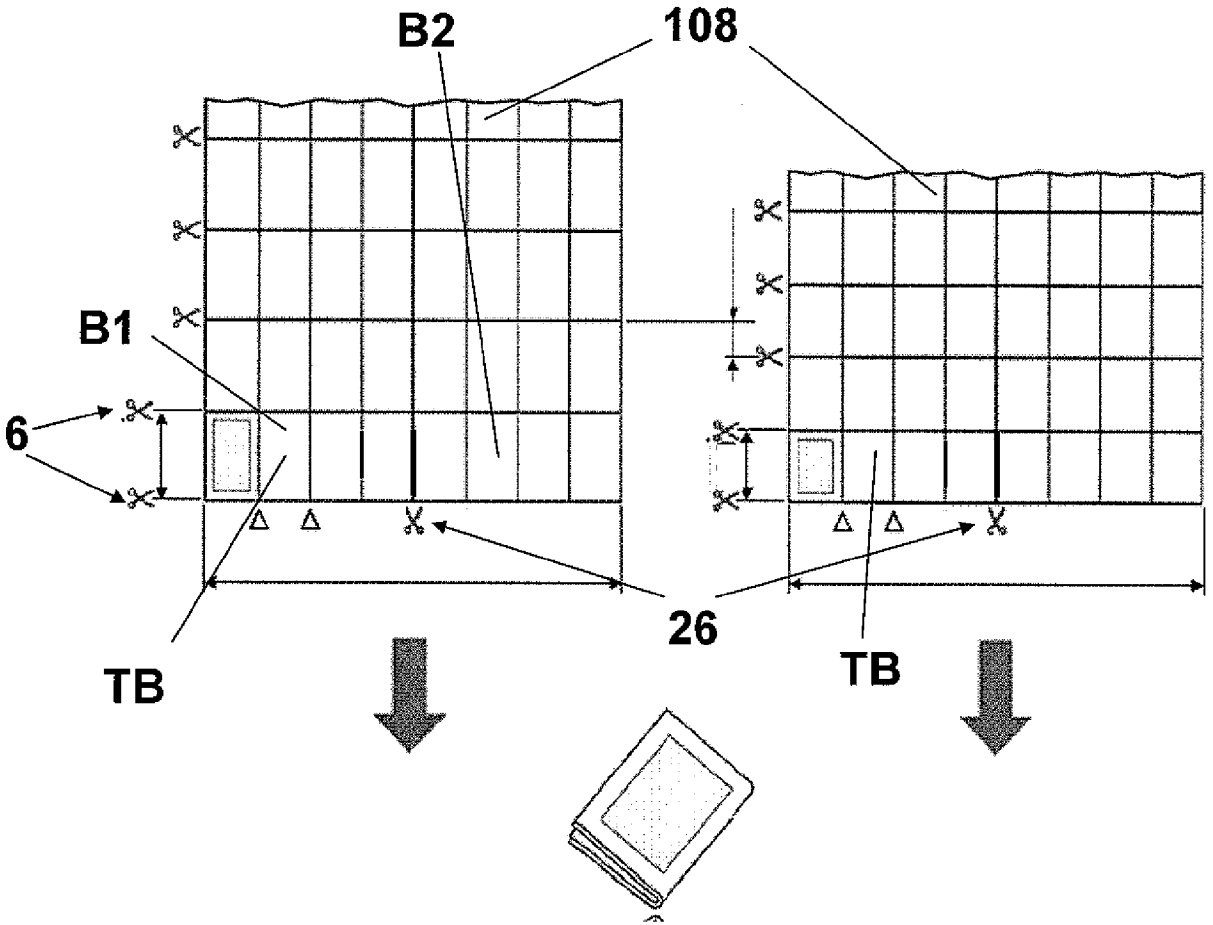
Figure 23:
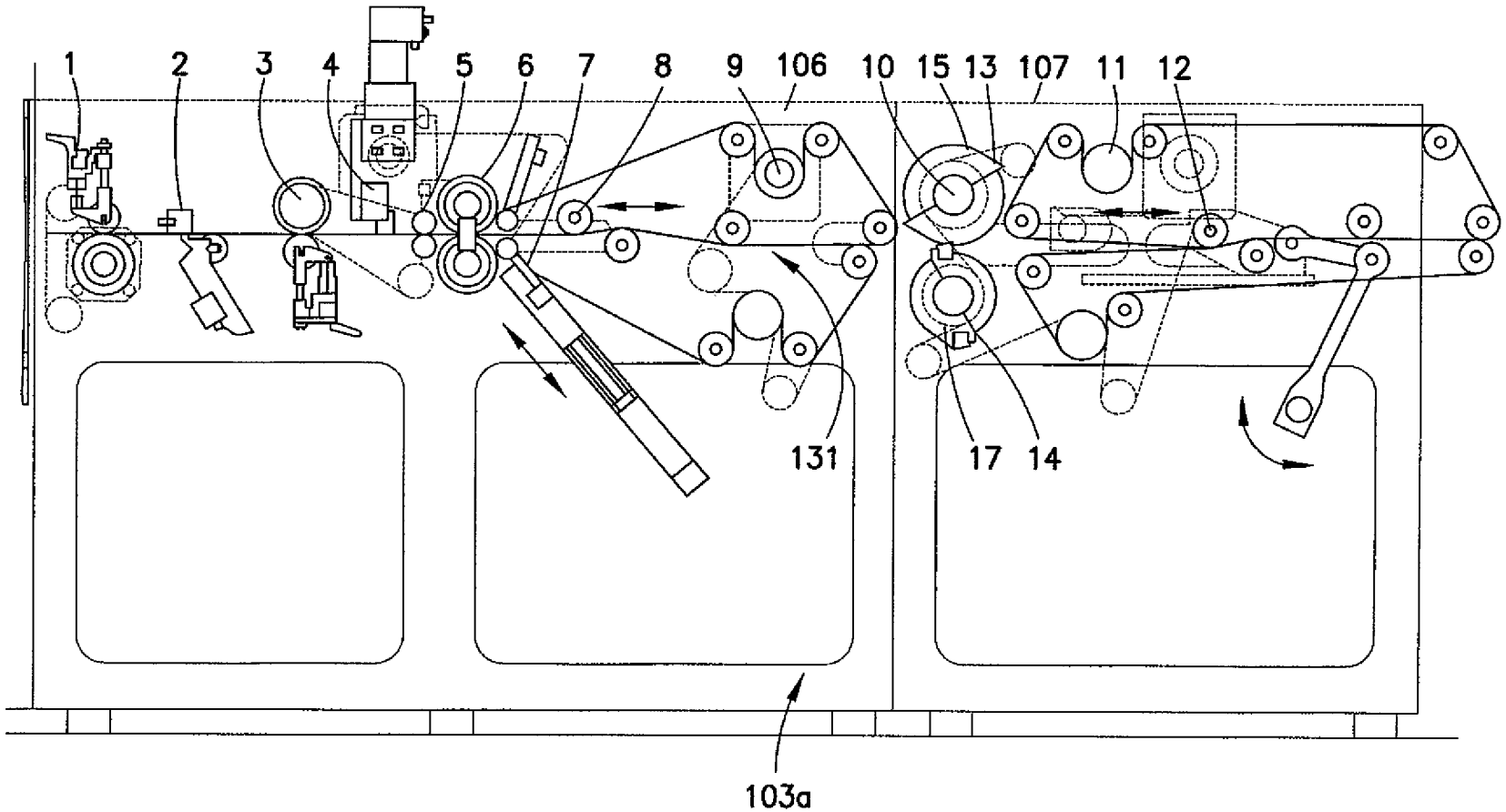
Figure 24:
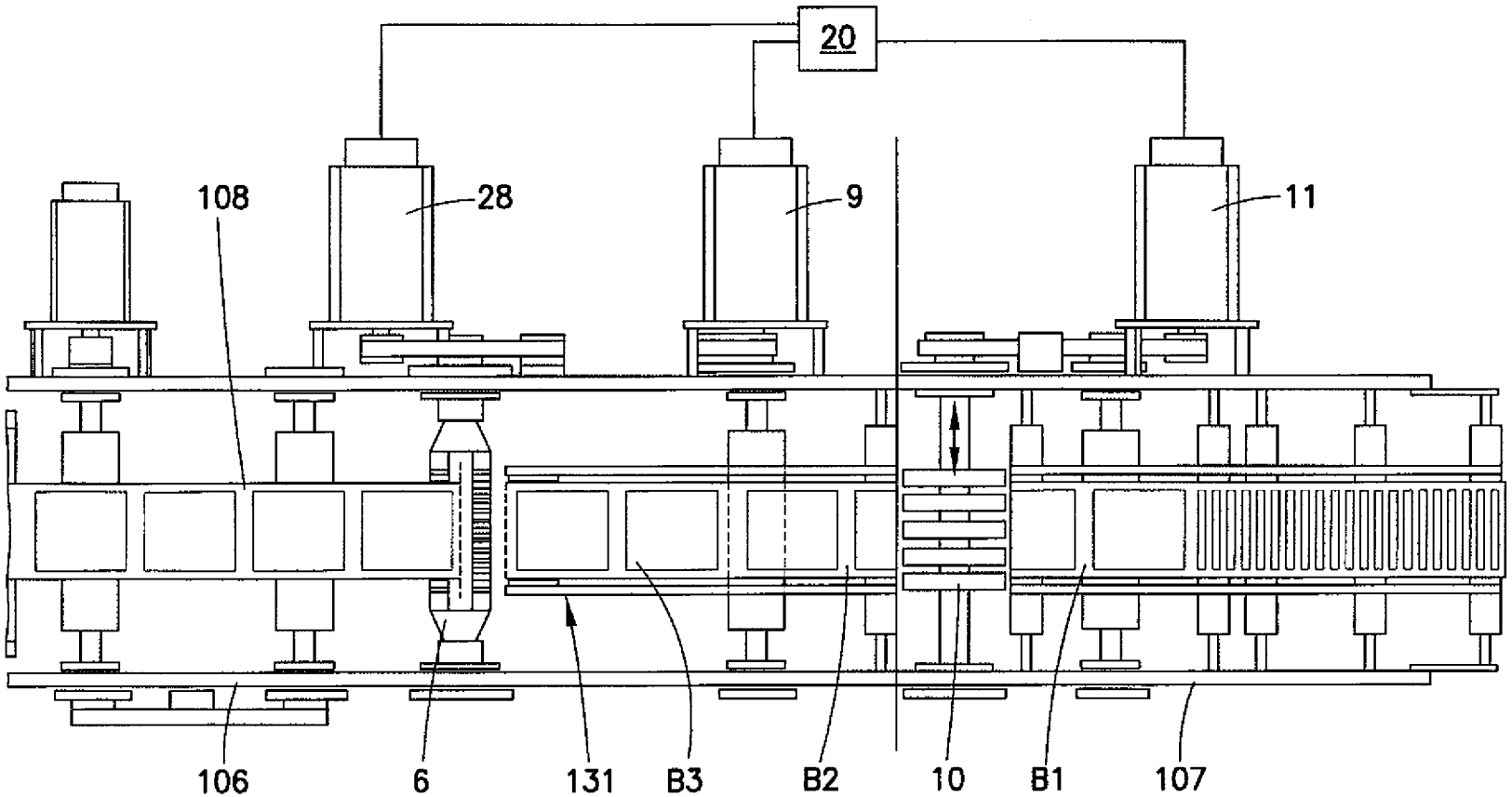
Figure 25:
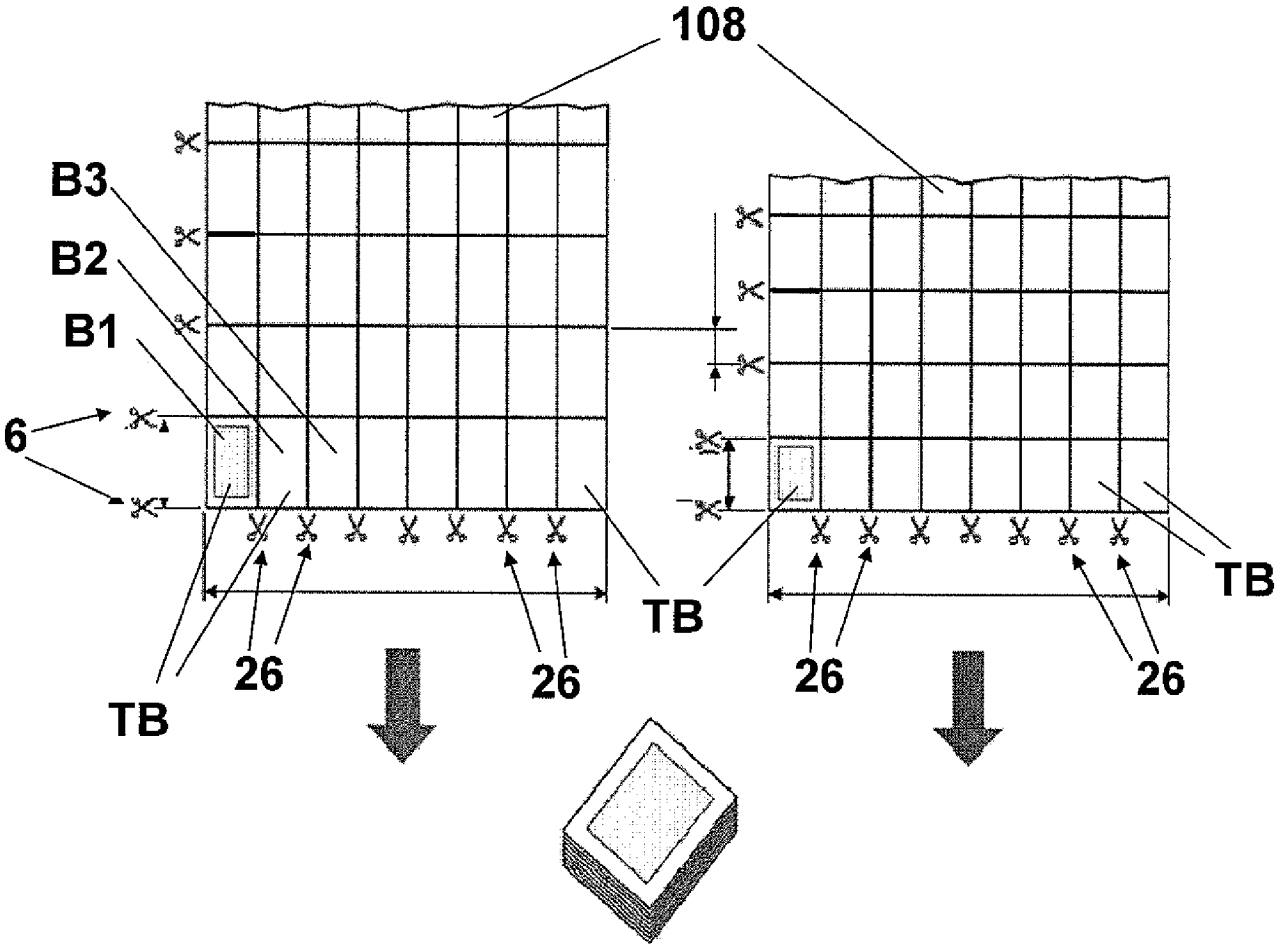
Figure 26:
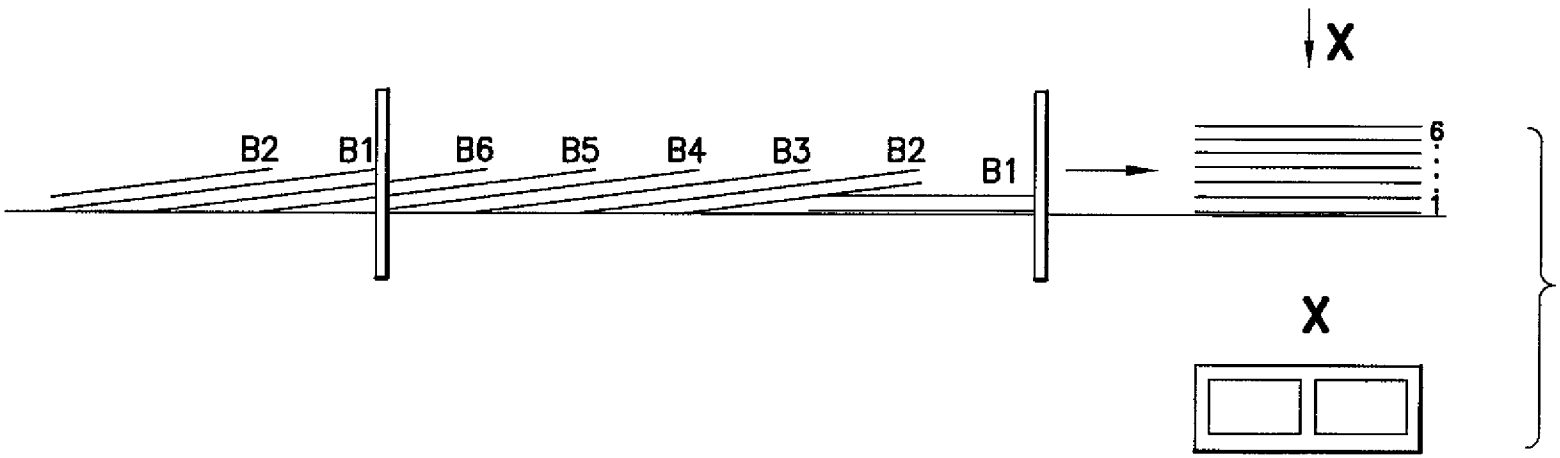
Figure 27:
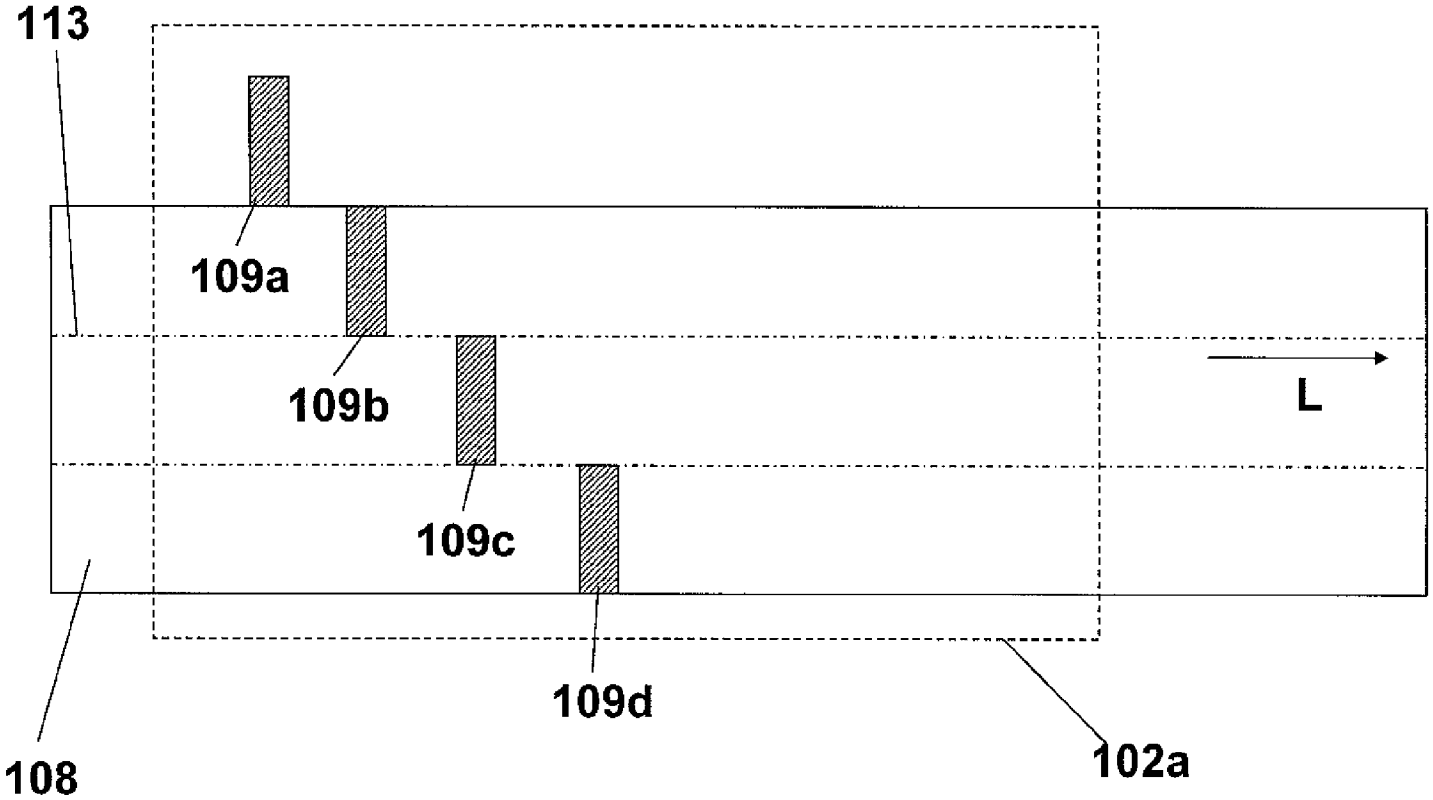

Specific embodiment examples of the present invention are shown in the following with reference to FIGS. 1 to 27. The drawings show:

FIG. 1 a variable format web press;

FIG. 2 a variable format web press with control;

FIG. 3 control curves;

FIG. 4 printing units for contactless printing, particularly with inkjet printing devices;

FIG. 5 arrangement of dryer below printing units for contactless printing, particularly with inkjet printing devices;

FIG. 6 arrangement of dryer above printing units for contactless printing, particularly with inkjet printing devices;

FIG. 7 printing devices extending over the entire width of the paper web;

FIG. 8 printing devices extending over part of the width of the paper web;

FIG. 9 printing devices overlapping transverse to the paper web;

FIG. 10 printing devices spaced apart from one another transverse to the paper web;

FIG. 11 groups of printing devices extending over part of the width of the paper web for applying different inks;

FIG. 12 alternative arrangement of groups of printing devices extending over part of the width of the paper web for applying different inks;

FIG. 13 printing devices with a plurality of segments for applying different inks;

FIG. 14 alternative construction of printing devices extending over part of the width of the paper web;

FIG. 15 alternative construction of groups of printing devices extending over part of the width of the paper web for applying different inks;

FIG. 16 folder (a) in a side view and (b) in a top view;

FIG. 17 arrangement of two displaceable formers;

FIG. 18 fold lines and web guidance on a former with printing devices extending over part of the width of the paper web;

FIG. 19 alternative fold lines and web guidance on two formers with printing devices extending over part of the width of the paper web;

FIG. 20 fold lines and web guidance on two formers with alternative printing devices extending over part of the width of the paper web;

FIG. 21 schematic view of a possibility for processing a paper web in the folder according to FIG. 16;

FIG. 22 schematic view of an alternative possibility for processing a paper web in the folder according to FIG. 16;

FIG. 23 post-processing equipment with cutting module and delivery module;

FIG. 24 top view of post-processing equipment with cutting module and delivery module according to FIG. 23;

FIG. 25 schematic view of a possibility for processing a paper web with a web turner device according to FIG. 16 and post-processing equipment according to FIGS. 23 and 24;

FIG. 26 shingling of paper sheets to form products comprising multiple layers; and FIG. 27 off-center guidance of a web section.

FIG. 1 shows a web press, particularly a variable format heatset web press, for example, for book printing or periodical printing. This web press has a reel changer 101 from which a paper web 108 is taken off and guided through printing units 102*a*, 102*b*. Subsequently, the paper web is guided to a folder 103 which includes the following: a web turner device 104, for example, in the form of a turner bar device, a folding module 105, a cutting module 106, and a delivery module 107. In a certain construction, the folding module 105 can also be omitted or can at least be circumvented as will be described in more detail in the following in connection with FIG. 25.

FIGS. 4 to 15 show that the printing units 102*a*, 102*b* have printing devices 109, 109*a*, 109*b*, 109*c*, 109*d* or groups 119, 119*a*, 119*b* of printing devices 109, 109*a*, 109*b*, 109*c*, 109*d*, none of which has rotating impression cylinders. The printing devices 109, 109*a*, 109*b*, 109*c*, 109*d* or groups 119, 119*a*, 119*b* of printing devices 109, 109*a*, 109*b*, 109*c*, 109*d* are designed for contactless application of ink to the paper web 108.

As is shown in FIGS. 5 and 6, the printing devices 109, 109*a*, 109*b*, 109*c*, 109*d* or groups 119, 119*a*, 119*b* of printing devices 109, 109*a*, 109*b*, 109*c*, 109*d* are constructed in the embodiment examples described herein as inkjet printing devices 109, 109*a*, 109*b*, 109*c*, 109*d* or groups 119, 119*a*, 119*b* of inkjet printing devices 109, 109*a*, 109*b*, 109*c*, 109*d*. The printing devices 109, 109*a*, 109*b*, 109*c*, 109*d* each have a nozzle device 139 for spraying ink on the paper web 108. These nozzle devices are shown explicitly only in FIGS. 5 and 6 but are also provided in the printing devices 109, 109*a*, 109*b*, 109*c*, 109*d* or groups 119, 119*a*, 119*b* of printing devices 109, 109*a*, 109*b*, 109*c*, 109*d* which are shown in the other drawings and constructed as inkjet printing devices.

FIG. 2 again shows the web press according to FIG. 1 with an associated control device 20. The control device 20 is provided for controlling and/or regulating the printing devices 109, 109*a*, 109*b*, 109*c*, 109*d* or groups 119, 119*a*, 119*b* of printing devices 109, 109*a*, 109*b*, 109*c*, 109*d*. At the same time, the control device 20 is also provided at least for controlling and/or regulating an actuating device 28 of at least one cutting device 6 for cutting at least a portion of the paper web 108. The actuating device 28 has a motor in this instance. According to FIG. 2 and FIG. 24, the cutting device 6 is constructed as a cutting knife cylinder with cutting knives 16 which rotates during the operation of the web press and accordingly brings the cutting knives 16 into regular contact with the paper web 108. According to FIG. 2 and FIG. 24, the motorized actuating device 28 is constructed as a drive motor.

The control and/or regulation of the actuating device 28 is carried out subject to print format settings 25, 26 for the printing devices 109, 109*a*, 109*b*, 109*c*, 109*d* or groups 119, 119*a*, 119*b* of printing devices 109, 109*a*, 109*b*, 109*c*, 109*d*. The control device 20 is constructed for controlling and/or regulating the motorized actuating device 28 as a function of pre-stored or pre-calculated control curves 27.

To this end, the control device 20 has a computing device or a data device 24 constructed as a data storage in which control curves 27 are stored or calculated. FIG. 3 shows schematically an example for control curves of this kind. These control curves according to FIG. 3 show the temporal curve of the angular velocity wS, wS' of the cutting knife 16 of the cutting device 6. The motorized actuating device 28—i.e., the drive motor—of the cutting device 6 is controlled or regulated in such a way that the cutting device 6 and, therefore, also every cutting knife 16 moves at varying angular velocity wS, wS' per revolution tU—that is, during the time span from t=0 to t=tU needed by the cutting cylinder to complete a revolution of 360°. The angular velocity wS, wS' varies according to FIG. 3 in such a way that when a cutting knife 16 contacts the paper web at time tK, the angular velocity wS, wS' of the cutting device 6 and, therefore, of every cutting knife 16—or, more precisely, the tangential component of the rotational velocity of the contacting cutting knife 16 in the running direction of the paper web at time tK—is equal to the conveying speed vB of the paper web 108, i.e., equal to the speed vB at which the paper web 108 moves through the printing machine. Accordingly, the rotational velocity is adapted in such a way per revolution of the rotating cutting device that at least when there is contact between the cutting knife 16 and the paper web 108, this cutting knife 16 and paper web 108 have the same speed so that there is no relative velocity between the two at the point of contact. If the angular velocity wS of the cutting device 6 and, therefore, also of every cutting knife 16—or, more precisely, the tangential component of the rotational velocity of the contacting cutting knife 16 in the running direction of the paper web 108—is less than the conveying speed vB of the paper web 108, the cutting knife 16 is accelerated to conveying speed vB at the time tK of contact between the cutting knife 16 and the paper web 108. If the angular velocity wS' of the cutting device 6 and, therefore, also of every cutting knife 16—or, more precisely, the tangential component of the rotational velocity of the contacting cutting knife 16 in the running direction of the paper web 108—is greater than the conveying speed vB of the paper web 108, the cutting knife 16 is slowed down to conveying speed vB at the time tK of contact between the cutting knife 16 and the paper web 108. This prevents a tearing or picking of the paper web 108.

The control device 20 has a controlling and/or regulating module 21 which has a data link to the data device 24 and to the printing devices 109, 109*a*, 109*b*, 109*c*, 109*d* and the motorized actuating device 28—i.e., the drive motor—of the cutting device 6.

Further, FIG. 2 shows that the control device 20 has, or at least can have, another data storage 22 in which print format settings 26 are stored and which has a data link to the controlling and/or regulating module 21. These print format settings 26 can be stored, e.g., in the form of pre-stored data relating to printed image formats or printed page formats, particularly in the form of data relating to the length (dimension in the running direction of the paper web 108) and/or width (dimension in direction transverse to the paper web 108) and alignment (distance of the printed image from the edge of the paper web 108, distances between the printed images, angles between the longitudinal edge of the printed image and the running direction L of the paper web 108).

Further, FIG. 2 shows that the control device has, or at least can have, a data processing device 23 in which print format settings 25 can be calculated and/or processed particularly in the form of data relating to the length (dimension in the running direction of the paper web 108) and/or width (dimension in direction transverse to the paper web 108) and alignment (distance of the printed image from the edge of the paper web 108, distances between the printed images, angles between the longitudinal edge of the printed image and the running direction L of the paper web 108). For example, pre-stored data relating to printed image formats or printed page formats which are stored in the data storage 22 can be read out, modified and/or processed by the data processing device 23, and/or new or modified data relating to printed image formats or printed page formats can also be entered by means of the data processing device 23 via other interfaces and transmitted to the controlling and/or regulating module 21 of the control device 20 by data link.

FIGS. 4 to 6 show examples of the internal construction of the printing units 102*a*, 102*b*. The paper web 108 is guided successively through the printing units 102*a*, 102*b*, for example, by means of suitable guide rollers or other web guiding elements. The paper web 108 is guided in the printing units 102*a*, 102*b* via web guiding elements 130 such as, e.g., support rollers, which are adjacent to the printing devices 109*a*, 109*b*, 109*c*, 109*d*. According to FIGS. 4 to 6, these web guiding elements 130 or support rollers are located across from the printing devices 109*a*, 109*b*, 109*c*, 109*d* on the other side of the paper web 108. The web guiding elements 130 or support rollers serve to guide the paper web 108 and cause a predefined distance to be maintained between the paper web 108 and the printing devices 109*a*, 109*b*, 109*c*, 109*d*. This distance can be fixed in principle, but can also be controlled or regulated by a control device such as the control device 20, e.g., in that the printing devices 109*a*, 109*b*, 109*c*, 109*d* or web guiding elements 130 are displaceable perpendicular to the plane of the paper web 108 as is indicated by the double-arrow in FIG. 4.

FIGS. 4 to 6 further show at least one dryer 110 arranged downstream of each of the printing units 102*a*, 102*b* in the running direction L of the paper web 108. Within the meaning of the invention, the running direction L of the paper web is not defined as a universal fixed plane in space because the paper web 108 executes several changes in direction and possibly also loops as is clearly indicated in FIG. 1. However, the person skilled in the art will be able to determine a clear spatial direction from the local running direction L of the paper web 108 in each particular instance, that is, for every section of the paper web 108.

FIG. 4 shows a construction in which each dryer 110 is structurally integrated in a printing unit 102*a*, 102*b*. Each dryer 110 can be structurally or spatially integrated in a printing unit 102*a*, 102*b* in such a way that the dryer operation is prevented from influencing the printing devices 109*a*, 109*b*, 109*c*, 109*d*. Accordingly, each dryer 110 can be arranged spatially above the printing devices 109*a*, 109*b*, 109*c*, 109*d* of the respective printing unit 102*a*, 102*b* as is shown in FIG. 6. This prevents the risk of an increase in generated heat and an unwanted heating of the printing devices 109*a*, 109*b*, 109*c*, 109*d*. However, as is shown in FIG. 5, the dryer 110 can also be arranged below the printing devices 109*a*, 109*b*, 109*c*, 109*d* of the respective printing unit 102*a*, 102*b* when the dryer 110 and printing unit 102*a*, 102*b* are suitably designed.

As is shown in FIGS. 1 to 15, the inkjet printing devices 109, 109*a*, 109*b*, 109*c*, 109*d* or groups 119, 119*a*, 119*b* of printing devices 109, 109*a*, 109*b*, 109*c*, 109*d* are fixed transverse to the running direction L of the paper web 108 during the printing process in principle. When constructed as inkjet printing devices 109, 109*a*, 109*b*, 109*c*, 109*d*, a movement of the printing devices 109, 109*a*, 109*b*, 109*c*, 109*d* is unnecessary during normal printing operation, and the number of moving parts is considerably minimized. However, for purposes of maintenance and exchange, printing devices 109, 109*a*, 109*b*, 109*c*, 109*d* or groups 119, 119*a*, 119*b* of printing devices 109, 109*a*, 109*b*, 109*c*, 109*d* can be swiveled out of a printing position by suitable bearings (e.g., eccentric cams or levers) or can be mounted so as to be displaceable by suitable bearings or guides (e.g., rails or sliding bearings).

As is shown in FIG. 7, the printing devices 109 or an entire group 119 of printing devices 109 in at least one printing unit 102*a* can extend over the entire width of the paper web 108 transverse to the running direction L of the paper web 108. The different printing devices 109 serve to print different inks. However, it can also be provided that only one individual printing device 109 extends over the entire width of the paper web 108 as is indicated by the dashed lines in the drawing of the other printing devices 109; that is, the latter can be provided optionally but are not absolutely necessary.

As is shown by the following FIGS. 8 to 15, printing devices 109*a*, 109*b*, 109*c*, 109*d* or groups 119*a*, 119*b*, 119*c*, 119*d* of printing devices 109*a*, 109*b*, 109*c*, 109*d* can extend over only part of the width of the paper web 108 transverse to the running direction L of the paper web 108. In this case, however, printing devices 109*a*, 109*b*, 109*c*, 109*d* or groups 119*a*, 119*b*, 119*c*, 119*d* of printing devices 109*a*, 109*b*, 109*c*, 109*d* are arranged so as to be offset relative to one another transverse to the running direction L of the paper web 108 as is shown in FIGS. 8 to 15. Typical paper web widths in web presses can be greater than 1 m and sometimes even appreciably greater than 1 m. When the printing devices extend over only part of the width of the paper web transverse to the running direction of the paper web but are arranged so as to be offset relative to one another, complicated and expensive full-width printing devices can be dispensed with, but printing is nevertheless carried out over the entire width of the paper web.

FIGS. 8 to 10 show examples in which two printing devices 109*a*, 109*b* are provided, each of which can print one half of the width of the paper web. The printing devices 109*a*, 109*b* need not necessarily print exactly one half of the width of the paper web. The printing devices 109*a*, 109*b* can overlap in at least one overlapping area 111 transverse to the running direction L of the paper web 108, considered in the running direction (L) of the paper web 108. This overlapping area 111 is accordingly printed upon by both printing devices 109*a*, 109*b* as is shown in FIG. 9.

Alternatively, according to FIG. 10, the printing devices 109*a*, 109*b*, considered in the running direction L of the paper web 108, can be spaced apart from one another by at least a clearance area 112 transverse to the running direction L of the paper web 108. Accordingly, neither of the two printing devices 109*a*, 109*b* prints in this clearance area 112.

This also applies in principle to the examples in FIGS. 11 to 15, i.e., one or more overlapping areas 11 and/or one or more clearance areas 112 can also be provided in a manner analogous to that shown in FIGS. 9 and 10 when there are more than two printing devices 109, 109*a*, 109*b*, 109*c*, 109*d*.

When overlapping areas 111 and/or clearance areas 112 of this kind are provided, then ideally an overlapping area 111 or a clearance area 112 is located in the area of a fold line 113, 114, 115 or at least one such fold line 113, 114, 115 occurs in an overlapping area 111 or a clearance area 112 as is shown in FIGS. 9 and 10. This also applies in the same way to fold lines 113, 114, 115 in the rest of the drawings. As is shown in FIGS. 18 to 20, the arrangement of folding devices T1, T2 and the guiding of the paper web 108 in the folder 103 are then configured in such a way that the fold lines 113, 114, 115 respectively define the folding of the paper web 108 by one of the folding devices T1, T2—i.e., a line toward the tip of the formers.

FIGS. 7, 11 to 13 and 15 show arrangements for printing a plurality of inks successively. These are distinguished from one another by different shading.

For this purpose, a plurality of printing devices 109, 109*a*, 109*b*, 109*c*, 109*d*—gathered into groups 119, 119*a*, 119*b* of printing devices 109, 109*a*, 109*b*, 109*c*, 109*d*—are arranged one behind the other in the running direction L of the paper web 108. These groups arise as a result of the common printing of a portion of the paper web 108 and/or a common controlling by the control device 20.

FIG. 13 shows that, alternatively or in addition, the printing devices 109*a*, 109*b*, 109*c*, 109*d* can also have a plurality of segments 129 transverse to the running direction L of the paper web 108 for applying different inks. These are distinguished from one another by different shading.

FIG. 16 shows a folder 103 which is arranged downstream of the printing units 102*a*, 102*b* or which can be arranged downstream of printing units 102*a*, 102*b* and which has a plurality of folding devices T1, T2 in the form of formers arranged in series in the running direction L of the paper web 108. The folding devices T1, T2 are arranged in a former module TM1, TM2. However, as will be explained with reference to FIG. 25, the folding devices T1, T2 can also be omitted or at least circumvented within the meaning of the invention.

Folder 103 comprises a web turner device 104, for example, in the form of a turner bar device, a folding module 105 (this may be omitted in the construction according to FIG. 25), a cutting module 106, and a delivery module 107. The cutting module 106 and delivery module 107 contain the following components: a first nipping section 1 (driven by an independent motor in the present example), a cutoff device 2, a second nipping section 3, a cutoff compensator camera 4, which is optional as the case may be, for visually monitoring the operation and functioning of the cutting device 6 and for supplying corresponding monitoring data to the control device (20), a small nipping section 5, a cutting device 6 with drive motor 28, a paper sheet transporting element 131 in the form of a conveyor belt, a swing-out device 7 for the paper sheet transporting element 131, a belt roller 8 which is adjustable to product length and print format, a drive 9 for the conveyor belt 7, a device 10 for slowing down the transporting movement of paper sheets B1, B2, B3 . . . with a drive 11 and a clamping point for the belt roller which is adjustable (to product length or print format).

As is shown in FIG. 17, the folding module 105 is constructed in such a way that every folding device T1, T2—that is, every former—is displaceable in at least one spatial direction R1, R2, The first folding device T1—i.e., the first former—is displaceable in a first spatial direction R1 parallel to the drawing plane (double-arrow), and the second folding device T2—i.e., the second former—is displaceable in a spatial direction R2 perpendicular thereto perpendicular to the drawing plane (tip of arrow indicated by a circle with a dot, end of arrow indicated by circle with a cross). This affords an improved freedom in the alignment and adaptation of the folding devices T1, T2 to a wide variety of print formats and paper web widths or paper web guidance without having to adapt (e.g., spatially displace) the components 1 to 12 of the post-processing equipment 103 arranged downstream in the running direction of the paper web 108 to modified print formats and paper web widths or paper web guidance. Rather, this can be implemented by the displacement of the folding devices T1, T2. In so doing, a change in the width of the paper web 108, for example, can be compensated in such a way by a displacement of the first folding device T1—i.e., the first former—in the first spatial direction R1 parallel to the drawing plane that the center of the folded paper web 108 is again located exactly on the fold line (dashed line) which leads to the tip of the second folding device T2—i.e., the tip of the second former. Accordingly, in particular, it is unnecessary to adapt the relative position and setup of the paper sheet transporting element 131 in the form of a belt conveyor to changed print formats and paper web widths or paper web guidance as is required in DE 40 30 863 A1.

As is shown in FIG. 17, the first folding device T1—i.e., the first former—is also displaceable in the second spatial direction R2 perpendicular to the drawing plane (tip of arrow indicated by circle with dot, end of arrow indicated by circle with cross). Accordingly, for example, an asymmetrical, i.e., off-center, guiding of the paper web through the printing devices can also be compensated by the displaceability on two axes accompanied by a variability of the web widths and print formats without having to adapt (e.g., spatially displace) components 1 to 12 of the post-processing equipment 103*a* arranged downstream in the running direction of the paper web 108 to changed print formats and paper web widths or paper web guidance. Accordingly, for example, instead of a full-width paper web 108 such as is shown, e.g., in FIGS. 8 to 15, only a partial width of the web can be guided through the printing units 102*a*, 102*b*, namely in such a way that it is not guided medially or symmetrically through the printing units 102*a*, 102*b*, but off-center or asymmetrically as is shown in FIG. 27. In this case, at least one of the partial-width printing devices 109*a*, 109*b*, 109*c*, 109*d* can be switched off, and the rest of the partial-width printing devices 109*a*, 109*b*, 109*c*, 109*d* are sufficient to print the paper web 108. The offset of the center of the paper web 108 relative to the center of the printing units 102*a*, 102*b* can then be compensated by displacing the first folding device T1—i.e., the first former—in the second spatial direction R2 perpendicular to the drawing plane.

As has already been described, the folder 103 or the post-processing equipment 103*a* has a paper sheet transporting element 131 with a drive 9 in the form of a motor in the present case, The drive 9 is controlled or regulated by the control device 20 or by a control device separate from the latter in such a way that paper sheets B1, B2, B3, B4, B5, B6 severed from the paper web 108 by the cutting device 6 are accelerated away from the rest of the paper web 108 in the running direction L of the paper web 108. This is shown in FIG. 24.

A device 10 with a drive 11—in the form of a motor in this case—is arranged downstream of the paper sheet transporting element 131. The drive 11 is also controlled or regulated by the control device 20 or by a separate control device, namely in such a way that the transporting movement of the previously accelerated paper sheets B1, B2, B3, B4, B5, B6 is slowed down. The device 10 is constructed in such a way that at least a portion of the paper sheets B1, B2, B3, B4, B5, B6, in addition to being slowed down, is lifted or lowered in order to achieve a shingling of the paper sheets B1, B2, B3, B4, B5, B6 as is shown in FIG. 26. This is carried out according to FIG. 23 by means of a disk or roller 15 having in circumferential direction at least one cam 13 which cooperates with a corresponding opposite cam 14 or a corresponding opposite disk or opposite roller 17.

FIG. 26 shows how the individual paper sheets B1, B2, B3, B4, B5, B6 are pushed together to form a shingle stream. This shingle steam is subsequently consolidated in a collator downstream to form a stack of paper sheets 1 . . . 6 laid one on top of the other, for example, to form a book body and, if necessary, the lateral edges are then cut again to obtain a stack of individual sheets, for example, in the form of a conventional book, as a final product of a book printing production mode. View X is a top view of this stack. In the example shown in FIG. 26, every sheet has two printed sides. This corresponds to the results of a production mode according to FIG. 21.

FIGS. 21 and 22 show production modes with the invention in which a (full-width) paper web 108 is cut by a longitudinal cutter 26 to divide the paper web 108 into web sections TB and is then guided successively via two formers (indicated by triangles) as is shown in FIGS. 16 to 20. Every web section TB is then subsequently cut by the cutting device 6 into paper sheets B1, B2.

As is shown in FIG. 25 in conjunction with FIGS. 23 and 24, the folder 103 need not necessarily have a folding module 105 with folding devices T1, T2. In a particular construction, the folding module 105 can also be omitted or can at least be circumvented. This can be carried out in a device or production mode of the folder 103 shown in FIG. 25. To this end, it is necessary only that a web turner device 104 is arranged downstream of the printing units 102*a*, 102*b* and has a plurality of longitudinal cutters 26 for dividing the paper web 108 into web sections TB and post-processing equipment 103*a* according to FIGS. 23 and 24 without a former which has a cutting module 106 for severing paper sheets B1, B2, B3, B4, B5, B6 from the rest of the paper web 108 and a delivery module 107 for gathering and/or delivering and/or shingling the paper sheets B1, B2, B3, B4, B5, B6.

Accordingly, the web sections TB generated in the web turner device 104 are not folded further but are merely cut again into paper sheets B1, B2, B3 by the cutting device 6, possibly after some or all of the web sections TB have been placed one on top of the other by corresponding devices such as turner bars in the web turner device 104. The paper sheets B1, B2, B3, B4, B5, B6 are then shingled again as is shown in FIG. 26.

The invention claimed is:

1. A web press comprising:

at least one printing unit, each of the at least one printing units comprising one of:

at least one printing device, or at least one group of printing devices, the at least one of the least one printing device and the at least one group of printing devices configured to apply ink to a paper web, and constructed without rotating impression cylinders, wherein a folder is arranged downstream of the at least one printing unit, the folder comprising a plurality of folding devices arranged one of in series and in parallel to one another in a running direction of the paper web.

2. The web press according to claim 1, wherein the at least one printing device or the at least one group of printing devices are configured to apply the ink to the paper web in a contactless manner.

3. The web press according to claim 1, further comprising a control device configured for at least one of controlling and regulating at least one of:

the at least one printing device or the at least one group of printing devices, and an actuating device of at least one cutting device configured to cut at least a portion of the paper web, based at least in part on print format settings for the at least one printing device or the at least one group of printing devices.

4. The web press according to claim 3, wherein the control device is configured to at least one of:

control a motorized actuating device of a cutting device with cutting knives and regulate the motorized actuating device of the cutting device with cutting knives.

5. The web press according to claim 3, wherein the control device is configured to at least one of:

control the actuating device based at least in part on at least one of pre-stored and pre-calculated control curves and regulate the actuating device based at least in part on the at least one of pre-stored and pre-calculated control curves.

6. The web press according to claim 3, wherein the at least one cutting device is configured as a rotating cutting device, and the control device for at least one of controlling and regulating the actuating device is constructed such that the cutting device is operable at a varying angular velocity per revolution, such that the angular velocity is equal to a conveying speed of the paper web when a cutting knife contacts the paper web.

7. The web press according to claim 1, wherein each the at least one printing device or group of printing devices has a respective nozzle device configured for spraying ink on the paper web.

8. The web press according to claim 1, wherein the at least one printing device or group of printing devices are fixed transverse to a running direction of the paper web during the printing process.

9. The web press according to claim 1, wherein the at least one printing device or the at least one group of printing devices are swivelably mounted to be displaceable out of a printing position.

10. The web press according to claim 1, wherein at least one of the at least one printing device, the at least one group of printing devices, and web guiding elements configured to guide a paper web are mounted so as to be displaceable perpendicular to the web plane.

11. The web press according to claim 1, wherein at least one of the at least one printing device, the at least one group of printing devices, and web guiding elements configured to guide a paper web are displaceable perpendicular to a web plane by a control device such that a predefined distance is maintained between the paper web and the at least one of the at least one printing device or the at least one group of printing devices.

12. The web press according to claim 1, wherein the at least one printing device or group of printing devices extend transverse to a running direction of the paper web over a portion of a width of the paper web, and the at least one printing device or group of printing devices are arranged offset relative to one another transverse to the running direction of the paper web.

13. The web press according to claim 1, wherein the at least one printing device or group of printing devices are arranged successively in a running direction of the paper web.

14. The web press according to claim 1, wherein respective printing devices of the at least one printing device or group of printing devices overlap transverse to a running direction of the paper web in at least one overlapping area.

15. The web press according to claim 1, wherein respective printing devices of the at least one printing device or group of printing devices are spaced apart from one another transverse to a running direction of the paper web by at least one clearance area.

16. The web press according to claim 14, wherein the at least one overlapping area lies in an area of a fold line.

17. The web press according to claim 1, wherein the at least one printing device or group of printing devices extend transverse to a running direction of the paper web over a full width of the paper web in each instance.

18. The web press according to claim 1, wherein respective printing devices of the at least one group of printing devices are configured for applying one or more inks.

19. The web press according to claim 1, wherein respective printing devices of the at least one printing device or group of printing devices each have a plurality of segments transverse to a running direction of the paper web for applying different inks.

20. The web press according to claim 1, further comprising at least one dryer arranged downstream of at least one of the printing units in a running direction of the paper web.

21. The web press according to claim 20, wherein the dryer is structurally integrated in a printing unit.

22. The web press according to claim 21, wherein the dryer is at least one of structurally and spatially integrated in a printing unit such that dryer operation is prevented from influencing respective printing devices.

23. The web press according to claim 22, wherein the dryer is arranged spatially above the respective printing devices of the at least one printing unit.

24. The web press according to claim 1, wherein the arrangement of the plural folding devices and the guiding of the paper web in the folder are effected such that fold lines each define the fold of the paper web by one of the plural folding devices.

25. The web press according to claim 1, wherein each of the plural folding devices is displaceable in at least one spatial direction, wherein a first folding device is displaceable in a first spatial direction, and a second folding device is displaceable in a spatial direction, the first and second spatial directions being perpendicularly arranged.

26. The web press according to claim 25, wherein one of the first folding device is additionally displaceable in the second or in a third spatial direction perpendicular to the first spatial direction.

27. The web press according to claim 1, wherein the folder comprises a paper sheet transporting element with a drive, wherein the drive is at least one of controlled and regulated by one of the control device and a separate control device such that paper sheets severed from the paper web by the cutting device are accelerated away from the paper web in a running direction of the paper web.

28. The web press according to claim 27, wherein a device with a drive is arranged downstream of the paper sheet transporting element, wherein the drive is one of controlled and regulated by one of the control device and a separate control device such that the transporting movement of the previously accelerated paper sheets is slowed down.

29. The web press according to claim 28, wherein the device is constructed such that at least a portion of each of the paper sheets is one of lifted and lowered for shingling the paper sheets.

30. The web press according to claim 1, further comprising:

a web turner device, arranged downstream of the at least one printing unit, comprising a plurality of longitudinal cutters configured to divide the paper web into web sections; and post-processing equipment, without a former, comprising a cutting module for severing paper sheets from the paper web and a delivery module for one of gathering, delivering, and shingling the paper sheets.

31. The web press according to claim 1, wherein the web press is one of a variable format book printing web press, variable format newspaper printing web press, and a variable format periodical printing web press, and wherein the printing devices are inkjet printing devices, the web press further comprising:

a control device for at least one of controlling and regulating the inkjet printing devices or groups of inkjet printing devices and for one of controlling and regulating an actuating device of at least one cutting device, wherein the one of the control and regulation of the actuating device is performed based at least in part on print format settings for the inkjet printing devices.

32. A control device for one of controlling and regulating the at least one printing devices and at least one group of printing devices according to claim 1, and an actuating device of at least one cutting device for cutting at least a portion of the paper web, wherein the one of the control and regulation of the actuating device is performed based at least in part on print format settings for the at least one printing device or group of printing devices.

33. Control device according to claim 32, wherein the control device is configured to at least one of:

control a motorized actuating device of a cutting device with cutting knives and regulate the motorized actuating device of the cutting device with cutting knives.

34. Control device according to claim 32, wherein the control device is configured to at least one of:

control the actuating device as a function of pre-stored or pre-calculated control curves and regulate the actuating device as the function of pre-stored or pre-calculated control curves.

35. Control device according to claim 32, wherein the control device is configured to at least one of:

control the actuating device of a rotating cutting device and regulate the actuating device of a rotating cutting device, and the control device is further configured to at least one of:

control the actuating device and regulate the actuating device, such that the cutting device can be operated at varying angular velocity per revolution, such that the angular velocity is equal to a conveying speed of the paper web when a cutting knife contacts the paper web.

36. A folder for use with one of a web press and a control device according to claim 3 wherein an actuating device of a rotating cutting device can be one of controlled and regulated by the control device such that the cutting device is operated at a varying angular velocity per revolution, such that the angular velocity is equal to a conveying speed of the paper web when a cutting knife contacts the paper web.

37. A folder for use with one of a web press and a control device wherein the web press comprises:

at least one printing unit, each of the at least one printing units comprising one of:

at least one printing device, or at least one group of printing devices, the at least one of the least one printing device and the at least one group of printing devices configured to apply ink to a paper web, and constructed without rotating impression cylinders; and wherein the control device is configured for at least one of controlling and regulating at least one of:

the at least one printing device or the at least one group of printing devices, and an actuating device of at least one cutting device configured to cut at least a portion of the paper web, based at least in part on print format settings for the at least one printing device or the at least one group of printing devices, wherein the folder comprises a paper sheet transporting element with a drive, wherein the drive is regulated by one of the control device or by a separate control device such that paper sheets severed from the paper web by the cutting device are accelerated away from the paper web in a running direction of the paper web.

38. The folder according to claim 37, wherein a plurality of folding devices are arranged in one of series and parallel to one another in the running direction of the paper web.

39. The folder according to claim 38, wherein each of the plural folding devices is displaceable in at least one spatial direction, wherein a first folding device is displaceable in a first spatial direction and the second folding device is displaceable in a spatial direction perpendicular thereto.

40. The folder according to claim 39, wherein the first folding device is additionally displaceable in at least one of the second spatial direction and a third spatial direction perpendicular to the first spatial direction.

41. The folder according to claim 37, wherein a device with a drive is arranged downstream of the paper sheet transporting element, wherein the drive is one of controlled and regulated by one of the control device and a separate control device such that the transporting movement of the previously accelerated paper sheets is slowed down.

42. The folder according to claim 41, wherein the device is constructed such that at least a portion of the paper sheets are one of lifted or lowered for shingling the paper sheets.

43. The folder according to claim 36 further comprising:

a web turner device and a plurality of longitudinal cutters for dividing the paper web into web sections; and post-processing equipment, without a former, which comprises a cutting module for severing paper sheets from the paper web and a delivery module for at least one of gathering, delivering, and shingling the paper sheets.

* * * * *